US008407953B2

(12) United States Patent
Neal

(10) Patent No.: US 8,407,953 B2
(45) **Date of Patent: *Apr. 2, 2013**

(54) WINDOW FRAMING SYSTEM

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,982

(22) Filed: Feb. 13, 2012

(65) Prior Publication Data

US 2012/0137626 A1 Jun. 7, 2012

Related U.S. Application Data

(62) Division of application No. 12/435,282, filed on May 4, 2009, now Pat. No. 8,112,953, which is a division of application No. 10/862,032, filed on Jun. 5, 2004, now Pat. No. 7,533,501.

(51) Int. Cl.
*E06B 3/06* (2006.01)
*E06B 1/00* (2006.01)

(52) U.S. Cl. ..... 52/204.54; 52/208; 52/213

(58) Field of Classification Search .. 52/204.53–204.55, 52/208, 212, 213, 235
See application file for complete search history.

(56) References Cited

U.S. PATENT DOCUMENTS

| | | | | |
|---|---|---|---|---|
| 2,810,941 | A * | 10/1957 | Mainieri | 52/201 |
| 2,949,981 | A | 8/1960 | Ferrell | |
| 3,203,053 | A | 8/1965 | Lane et al. | |
| 3,994,243 | A | 11/1976 | Anders | |
| 4,251,964 | A | 2/1981 | Francis | |
| 4,330,972 | A | 5/1982 | Sailor | |
| 4,563,849 | A | 1/1986 | Mangal | |
| 4,574,546 | A | 3/1986 | Gartner | |

(Continued)

FOREIGN PATENT DOCUMENTS

| | | | |
|---|---|---|---|
| DE | 3700202 | A1 | 7/1988 |
| DE | 8902232 | U | 8/1989 |
| EP | 0436868 | A2 | 7/1991 |
| JP | 02085492 | A | 3/1990 |
| WO | WO-8601249 | A | 2/1986 |

OTHER PUBLICATIONS

Neal, Murray L., Final Office Action dated Sep. 3, 2008, U.S. Appl. No. 10/862,032, filed Jun. 5, 2004, 12 pgs.

(Continued)

*Primary Examiner* — Christine T Cajilig
(74) *Attorney, Agent, or Firm* — Blakely Sokoloff Taylor & Zafman LLP

(57) ABSTRACT

Pieces that are components of a frame for a window having a threat side and a safe side include a base and a pressure plate that together form part of one of a sill section, a head section, and a jamb section of the window. The base and pressure plate are elongated in a longitudinal direction. The base has (1) an L-shaped cross-section at a near portion of the base to receive an end of a glazing unit from the threat side of the window, and (2) a first pocket formed in a far portion of the base and running in said longitudinal direction. The rear portion is closer to the threat side than the far portion. The pressure plate is to be assembled with the base so as to secure the glazing unit in the corner. Other embodiments are also described and claimed.

16 Claims, 29 Drawing Sheets

U.S. PATENT DOCUMENTS

| | | | |
|---|---|---|---|
| 4,903,454 | A | 2/1990 | Rose |
| 5,036,640 | A | 8/1991 | Niwata et al. |
| 5,293,723 | A | 3/1994 | Slessor |
| 5,513,476 | A | 5/1996 | Jones |
| 6,141,925 | A | 11/2000 | Halvorson, Jr. et al. |
| 6,158,182 | A | 12/2000 | Biebuyck |
| 6,182,405 | B1 | 2/2001 | Lindahl |
| 6,185,882 | B1 | 2/2001 | Pearson |
| D442,293 | S | 5/2001 | Habeck et al. |
| 6,550,210 | B1 | 4/2003 | Levine et al. |
| 6,578,340 | B2 | 6/2003 | Ishikawa et al. |
| 6,804,920 | B2 | 10/2004 | Hogan |
| 2003/0221381 | A1 | 12/2003 | Ting |

OTHER PUBLICATIONS

Pinnacle, Final Office Action (dated Nov. 17, 2008), U.S. Appl. No. 10/862,032, filed Jun. 5, 2004, First Named Inventor: Murray L. Neal, 13 pages.

Pinnacle, Non-Final Office Action (dated Mar. 5, 2008), U.S. Appl. No. 10/862,032, filed Jun. 5, 2004, First Named Inventor, Murray L. Neal, 17 pages.

Pinnacle, Final Office Action (dated Jul. 12, 2007), U.S. Appl. No. 10/862,032, filed Jun. 5, 2004, First Named Inventor, Murray L. Neal, 11 pages.

Pinnacle, Non-Final Office Action (dated Feb. 8, 2007), U.S. Appl. No. 10/862,032, filed Jun. 5, 2004, First Named Inventor, Murray L. Neal, 11 pages.

Pinnacle, Non-Final Office Action (dated Apr. 5, 2006), U.S. Appl. No. 10/862,032, filed Jun. 5, 2004, First Named Inventor, Murray L. Neal, 12 pages.

Pinnacle, PCT International Search Report (dated Dec. 28, 2004), International Application No. PCT/US2004/031166, International Filing Date—Sep. 22, 2004, Whole Document.

* cited by examiner

Corner Section

Corner Section

Corner Section

03
DOUBLE
MULLION

SHADOW BOX STYLE 1

SHADOW BOX STYLE 2

13
SILL

WINDOW FRAMING SYSTEM

CROSS-REFERENCE TO RELATED APPLICATION

The application is a divisional of U.S. patent application Ser. No. 12/435,282, filed May 4, 2009, now U.S. Pat. No. 8,112,953, which is a divisional of U.S. patent application Ser. No. 10/862,032, filed Jun. 5, 2004, now U.S. Pat. No. 7,533,501, and incorporated herein by reference.

BACKGROUND

An embodiment of the invention relates generally to frames that support glazings for windows, and more specifically, to an improved primary frame for supporting security glazings, e.g. glazings that are designed to mitigate explosive blasts. Other embodiments are also described and claimed.

In an increasingly violent society, businesses and government institutions are subject to a greater number of threats against both life and property. Such threats may be in the form of ballistic threats, explosive blasts, forced entries, as well as others. Security measures have been taken to protect against such threats. These include the installation of special windows that have increased strength, to withstand an attack. For example, windows that have security glazings that can resist certain explosive blasts, ballistic threats, and/or forced entry threats are being specified in new commercial, as well as industrial buildings. Such windows may also present better resistance to natural disasters such as hurricanes, tornadoes, and severe storms.

Conventional windows that call for security glazings have a primary frame to secure a glazing unit, within a defined casement opening of a building, for example. The frame is referred to as a "primary" frame because it may be the only frame that is needed to close the given opening between a "threat side" and a "safe side". Where the threat side is outside of the building, and the safe side is inside the building, the primary frame serves not only to secure the glazing, but to also weatherproof the opening. A conventional method for installing a primary, ballistic resistant glazing frame involves pre-welding four L-shaped pieces of solid steel that are sized to fit a given opening of the building and then bringing the welded sub-frame to the job site, anchoring this welded sub-frame to the building material that surrounds the opening (such as a sill, king studs, and a header), placing the glazing unit against the secured sub-frame, and then anchoring four pieces of square, tubular steel glazing stop to all four sides of the sub-frame to secure the glazing in place.

BRIEF DESCRIPTION OF THE DRAWINGS

The embodiments of the invention are illustrated by way of example and not by way of limitation in the figures of the accompanying drawings in which like references indicate similar elements. It should be noted that references to "an" embodiment of the invention in this disclosure are not necessarily to the same embodiment, and they mean at least one.

DETAILED DESCRIPTION

Figure 1:
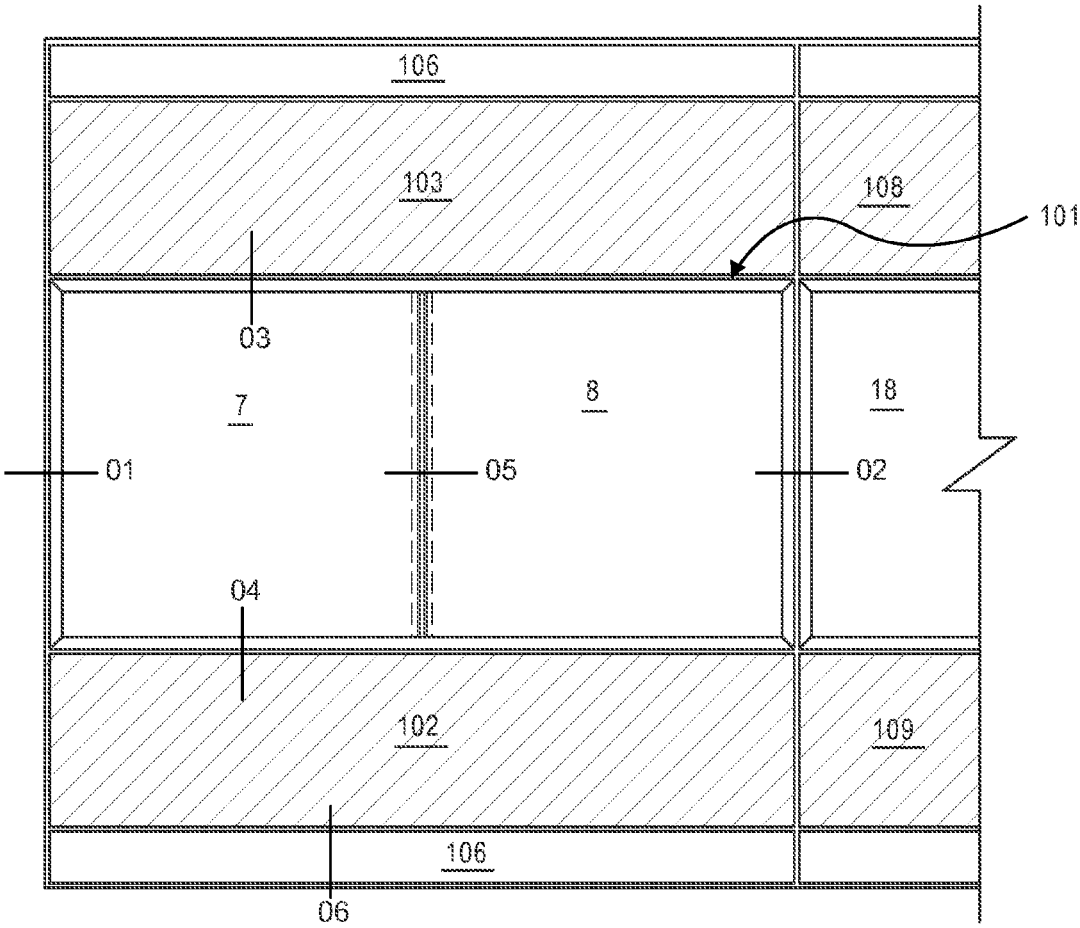
FIG. 1 is an elevation view of a multi-strip window unit installed in a building.

A disadvantage associated with the conventional security windows described above is the relatively high cost associated with pre-forming a welded steel sub-frame (of a primary frame). According to an embodiment of the invention, a window framing system has a number of separate pieces that are structural components of a primary frame, where the pieces are preformed and may be assembled so as to build the frame at the job site. The pieces may be cut off a preformed beam of extruded metal, such as aluminum (either at the job site or delivered as cut to the site). The pieces may also be assembled into an entire frame held together by fasteners (e.g., a screw splined system), without having to weld the pieces together. For higher threat applications, shear blocks made of steel and/or aluminum, for example, may be inserted into preformed pockets in the pieces.

The primary frame may be the only one that closes an opening of a building between a threat side and a safe side. Where the threat side is defined to be outside of the building, the assembled primary frame can provide the needed weather seal/proofing, and in the case of strip and punch windows should be designed to have the required depth so as to cover the casement area of the opening. In most embodiments, the structural pieces that make up the primary frame include a base and a pressure plate for each side of the frame, that may be used to easily secure security glazings of different thicknesses. The base and pressure plate have a unique structure that advantageously allows them to be re-used for many different styles of security windows, thus helping lower their cost of manufacture and assembly. Additional embodiments will be described below.

The term "window" will be used to alternatively refer to a punch window, a strip window, and a curtain wall. A punch window may be defined as having a single pane of glass, or monolithic laminated single pane that is a single glazing unit, or a double insulated glazing unit to be installed into an opening of an existing wall of a building. The punch window typically needs four sides to be present for the opening. The strip window, in contrast, has two or more horizontally oriented glazing units (typically not stacked vertically). The strip window may also need four sides to its opening. An example is a conventional store front, where there could be two strip windows, a lower one having multiple smaller panes made of tempered glass, and an upper one having panes that are not made of tempered glass. The tempered glass is generally more expensive, however, it is preferred for better safety and security in areas where people will be walking. Finally, a curtain wall may be viewed as a window that is installed as an entire wall of a building during initial construction. This may be an entire exterior wall, filling the entire area from the floor to the ceiling of a single story. Most conventional high rise buildings have curtain walls, rather than punch or strip windows on the upper floors.

Beginning with FIG. 1, this figure is an elevation view of a window unit 101 installed in a building. A single story of the building is illustrated, where the floor is defined by the substrate block 102 and the ceiling is defined by the substrate block 103. The substrate material in this case is concrete; however, the window may be installed in buildings having different substrate building materials or support structures, such as wood and/or steel framing. A panel flashing 106 may be added as an aesthetic feature, covering the substrate. This combination of flashing, substrate, window, substrate, and panel flashing may be repeated for each story of the building.

Figure 2:
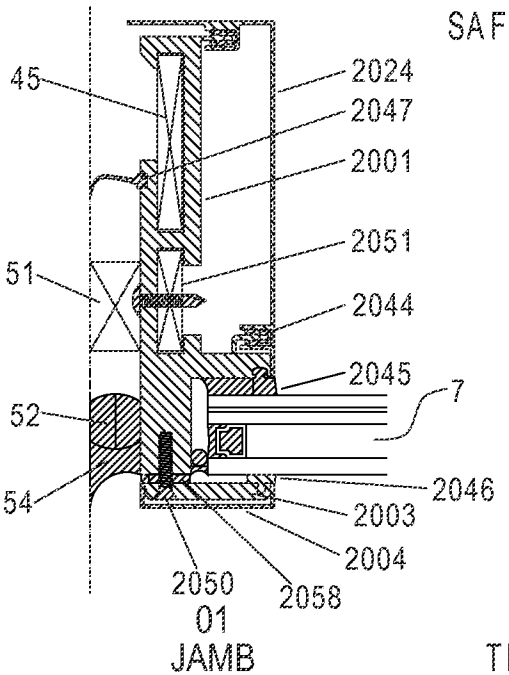
FIG. 2 is a sectional view of a floating jamb section of the window.

The window unit shown in FIG. 1, may be assembled to a single unit, that is unitized, before being shipped to the job site. Alternatively, the pieces of the window may be shipped to the job site and then assembled at the job site. The window has two glazing units 7, 8. FIG. 2 illustrates a sectional view of how the glazing unit 7 is supported by a floating jamb section (viewed along plane 1 of FIG. 1). The jamb section (or simply, jamb) floats in the sense that it is not anchored to the support structure of the building. Rather, in this embodiment, it is the head and sill sections that are anchored. These are shown in sectional views taken through planes 3 and 4, respectively. Various techniques for anchoring the frame to the support structure of the building will be described below.

Figure 3:
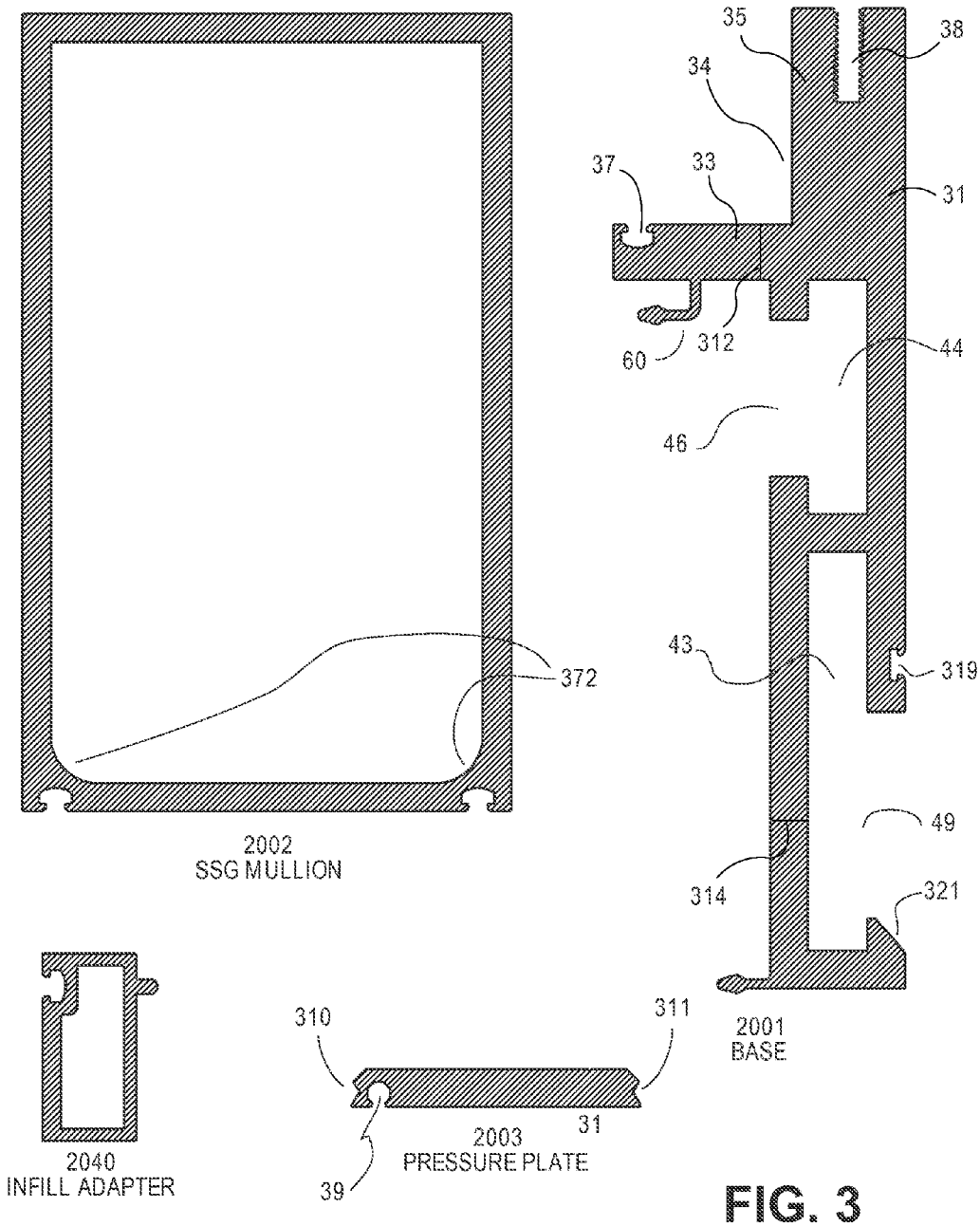
FIG. 3 is a sectional view of a base piece, a pressure plate, a mullion, and an in-fill adapter that may be used in the jamb, sill, head, and mullion sections of the window.

Referring now to FIG. 2, the floating jamb section includes a base 2001 and a pressure plate 2003. Since what is shown is a sectional view, it is understood that the base and pressure plate pieces are elongated in a longitudinal direction that is perpendicular to the page. An expanded view of the base is shown in FIG. 3, where an L-shaped section 31 at a near portion of the base, that is near the threat side, is to receive an end of the glazing unit 7 from the threat side of the window. In this embodiment, the glazing unit 7 is made of insulated glass and is relatively thick, as compared to a much thinner non-insulated version. The L-shaped section 31 should be engineered so that the glazing unit as secured in the window can withstand, for example, an explosive blast as specified in overblast peak ambient pressures measured in pounds per square inch, with a given time pulse requirement. This would include engineering the material used, which is preferably 6063 T6 aluminum suitable for extrusions, as well as the dimensions of the first and second segments 33, 35. In particular, the thickness 312 of the segment 33 is preferably greater than that of the rest of the base towards the far portion, e.g. thickness 314. The glazing unit is secured in a corner 34 of the L-shaped section, in this embodiment, by resting against a gasket or seal 2045 (see FIG. 2) made of a suitable material such as Ethylene Propylene Diene Monomer (EPDM). This gasket has been inserted into a preformed groove 37 in the first segment 33 of the L-shaped section. A similar type of seal or gasket 2046 (see FIG. 2) may be installed in another groove 39 in the pressure plate 2003 as shown, so that when the pressure plate is installed against the glazing unit, there is less chance of breaking the glass when tightening down the pressure plate. In addition, the gasket provides a weather tight seal. A fastener mechanism, such as multiple screws 2050, spaced every twelve inches, for example, which distance may vary dependent upon the thread severity, in a longitudinal direction along the pressure plate, may be used to secure the plate 2003 to the second segment 35 of the L-shaped section 31. An extruded channel 38 may be formed in the second segment 35 of the L-shaped section, for threadingly receiving the screws. A strip of thermal barrier tape 2058 (see FIG. 2) may also be added to help avoid thermal transfer resulting in sweating due to large temperature differences between the threat side and the safe side.

Referring again to FIG. 3, the base 2001 also has a first pocket 43 formed in a far portion of the base, that is farther from the threat side of the window. It is again understood that, in this embodiment, the first pocket 43, as well as the L-shaped section 31, run the entire length of the base in the longitudinal direction that is perpendicular to the page. This helps when positioning a base anchor extension piece, by allowing the extension piece to slide along the length of the base to the desired anchoring position. The base 2001 may also have an angle 321 formed at the edge of the opening 49 as shown. This angle 321 and its corresponding angle 1821 in the base extension piece (see FIG. 18, base angle 2015) allow for a stronger base extension piece for the same thickness. In addition, the angle 321 helps the base better withstand torsion created by an explosive blast. Still referring to FIG. 3, the addition of the radius 372 to the front corners of the mullion 2002 also helps better withstand the forces generated by an explosive blast.

The first pocket 43 may be shaped to mate with a shear block 45 (see FIG. 2), allowing the shear block 45 to slide into the first pocket in the longitudinal direction and be locked in a transverse direction. The shear block may be made of, for example, 6061 T6 aluminum or, for higher threat levels, steel. In very high threat applications, the shear block may run substantially the entire length of the base. For even greater resistance to shear, a second pocket 44 (FIG. 3) may be formed in a middle portion of the base, that is between the L-shaped section 31 and the first pocket 43. This second pocket 44 may also run the entire length of the base in the longitudinal direction, and is shaped to receive another shear block 2051 (FIG. 2) to further withstand shear and torsion caused by an explosive blast from the threat side.

The base may have an opening 49 to the first pocket 43, and an opening 46 to the second pocket 44 that also runs the entire length of the base. The opening 46 allows different sizes and shapes of shear blocks 2051 to be installed in the second pocket, so as to tailor a frame to withstand different levels of shear. The opening 49 may be used to receive a base anchor extension piece to be described below, for anchoring the frame to the building substrate. The width of the opening 49 (perpendicular to the longitudinal axis) should be sufficiently great so as to allow the same base extrusion to be used with different sizes and shapes of anchor extension pieces. Note that in the floating jamb embodiment, depicted in FIG. 2, there is no need for such anchoring. However, some type of spacer 51, such as shims that are stacked to get the appropriate thickness (or alternatively a rubber spacing block placed at the job site) to align the window with the rest of the floor may be needed.

The primary weather proofing for this framing system is obtained by inserting a foam backer rod 52 between the substrate and the second segment 35 of the L-shaped section as shown in FIG. 2, followed by the application of caulking or other sealant/adhesive 54, for greater resistance to wind and moisture. A similar combination of a foam backer rod and liquid caulking may be applied between the glazing unit 7 and the opposite side of the second segment 35 of the L-shaped cross-section. A secondary barrier to moisture and wind may be obtained by using a rubber finger sweep 2047 that is inserted in a groove 319 formed on the substrate side of the base, as shown.

The window framing system may be fitted with cover pieces or caps that may be snap fitted into position for aesthetic purposes. In this case, a cap 2004 covers the pressure plate while a cover piece 2024 covers the inside of the base, as shown. The latter is sized to fit over the base and has a clip 2044 which may be a PVC clip to thermally insulate the cover and the base, to act as a secondary barrier to condensation formation on the base. The base 2001 in this case further includes a finger 60 (see FIG. 3) that is formed integrally with the base as part of the same extruded piece of metal, to receive the clip. A further weather barrier in the form of a heal bead (not shown) that covers about ⅛ inch on the glazing and ⅛ inch on the pressure plate should be added to the installation.

Figure 4:
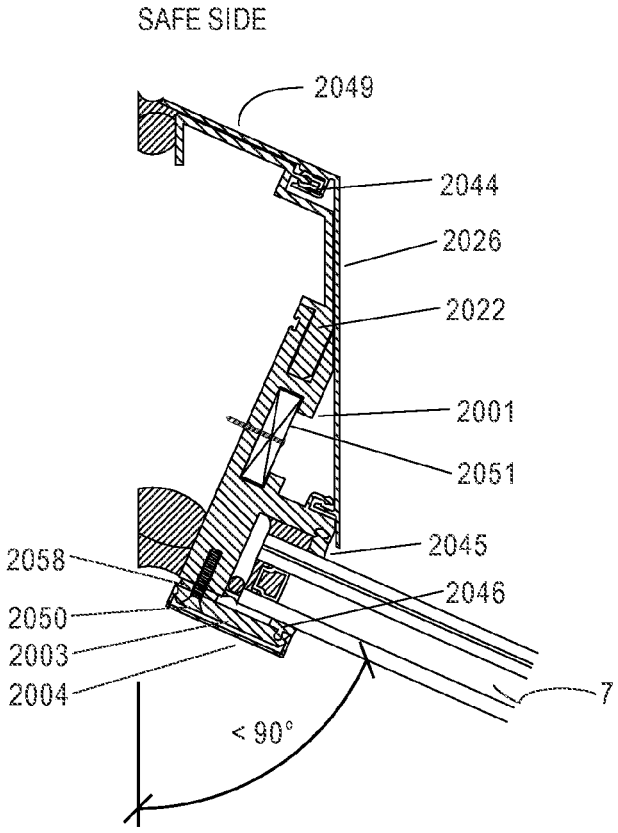
FIG. 4 is a sectional view of another floating jamb section.

Referring now to FIG. 4, this is a sectional view of another embodiment of a floating jamb, where the glazing unit 7, as installed, is angled less than ninety degrees with respect to the substrate. This is achieved, in this embodiment, by cutting back into the base 2001 and fitting, within the cut back area of the first pocket 43, an inside angle base extension 2022. The latter extends out of the opening 49 (see FIG. 3) and reaches the substrate as shown. At the far end of the frame, the stool condition 2026 is long enough to reach the substrate so that a backer rod and caulking combination may be added as part of the primary weather seal.

Figure 5:
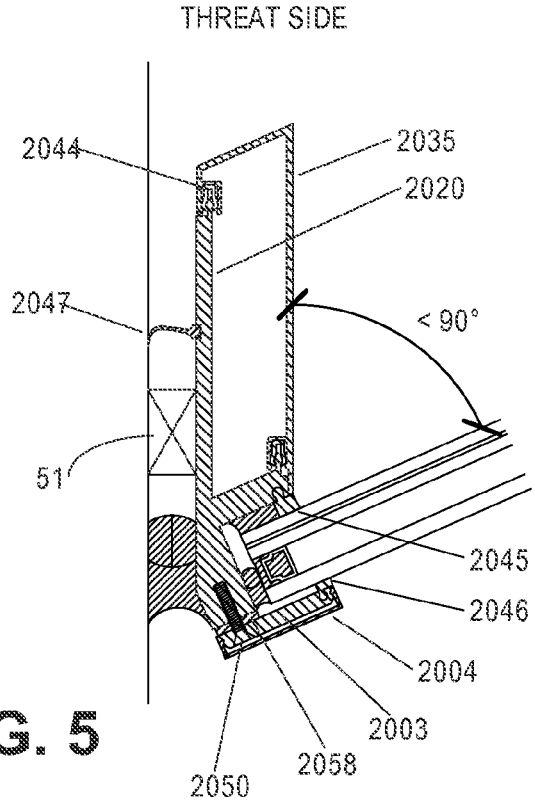
FIG. 5 is a sectional view of another floating jamb section.

In another embodiment shown in FIG. 5, an angled base 2020 is formed, so that the first segment 33 of the L-shaped section 31 (see FIG. 3) makes an angle less than ninety degrees with respect to the far portion of the base. In addition, no pocket need be formed as the needed resistance to explosive blasts is obtained without the need for either of the shear blocks 45, 2051 (see FIG. 2) due to the increased depth of the base (relative to those used in the head and sill). The shape of the cover cap 2035 is also modified. However, the pressure plate 2003 need not be different than the versions used for the right angle jamb of FIG. 2.

Figure 6:
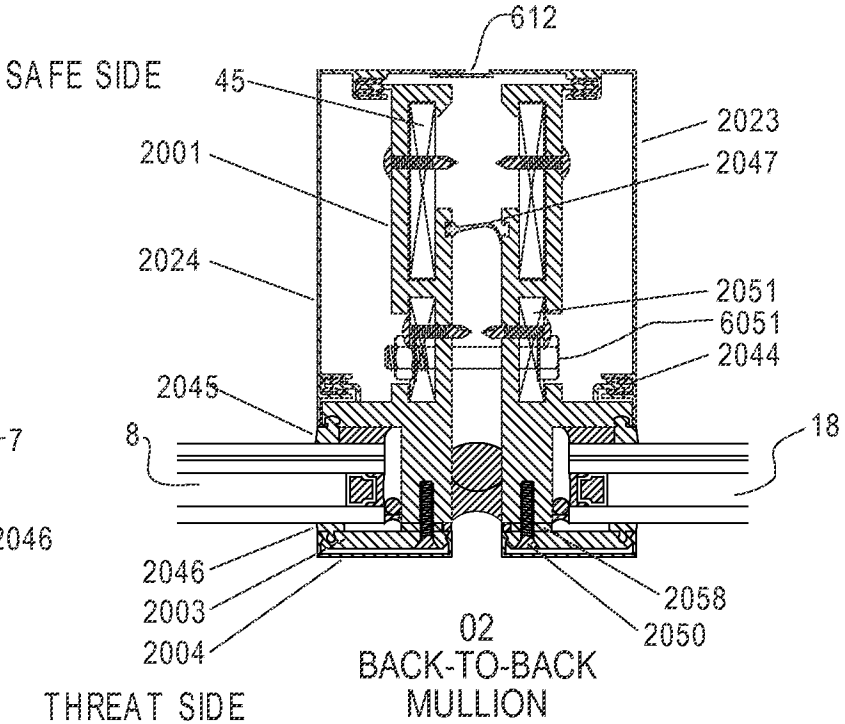
FIG. 6 is a sectional view of a back-to-back mullion section where two adjacent, unitized windows come together.

Turning now to FIG. 6, this figure shows a sectional view of a back-to-back mullion (see FIG. 1, plane 2) that results from two adjacent, unitized windows in the same plane. The back-to-back mullion follows, in this example, the site line between horizontally adjacent concrete blocks 103, 108 and blocks 102, 109 that may be part of the architectural or aesthetic requirements of the building. In this example, the back-to-back mullions are separated by approximately three-quarters of an inch, although in general they may be spaced further or they may abut each other. Note the stool condition in this case that is achieved by cover pieces 2024 and 2023, where the latter has an extension piece 612 that slides against the end of the former to allow some movement between the adjacent window frames. Note also how the finger sweep 2047 provides the secondary weather seal by closing off the gap between the adjacent bases. The back-to-back mullion also has a number of fasteners 6051 spaced in the longitudinal direction (e.g., every two feet) that secure the two bases of the back-to-back mullion to each other through, for example, the shear blocks 2051 that have been inserted into the second pockets.

Figure 7:
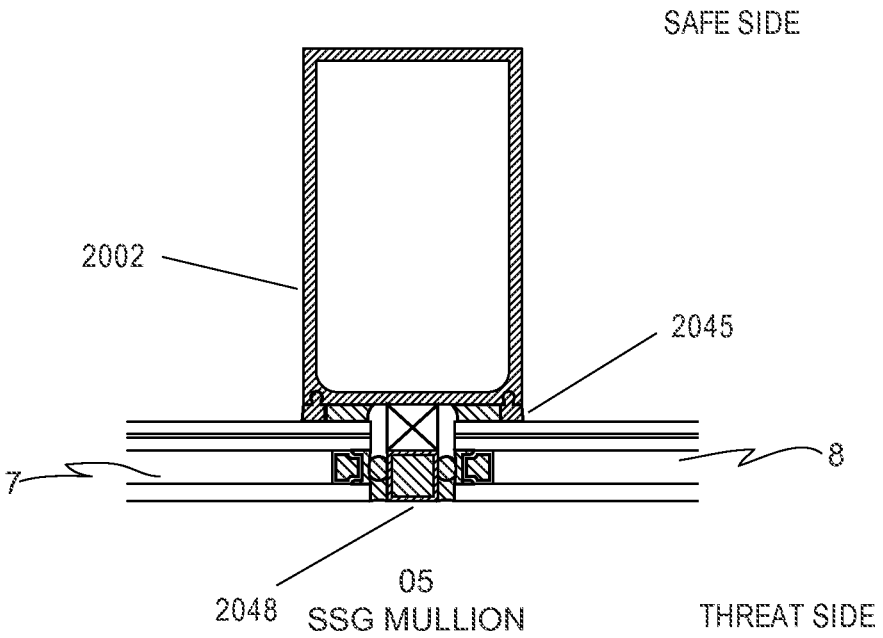
FIG. 7 is a sectional view of a mullion section that may be used without a pressure plate, to form a unitized window having multiple glazing units.
Figure 8:
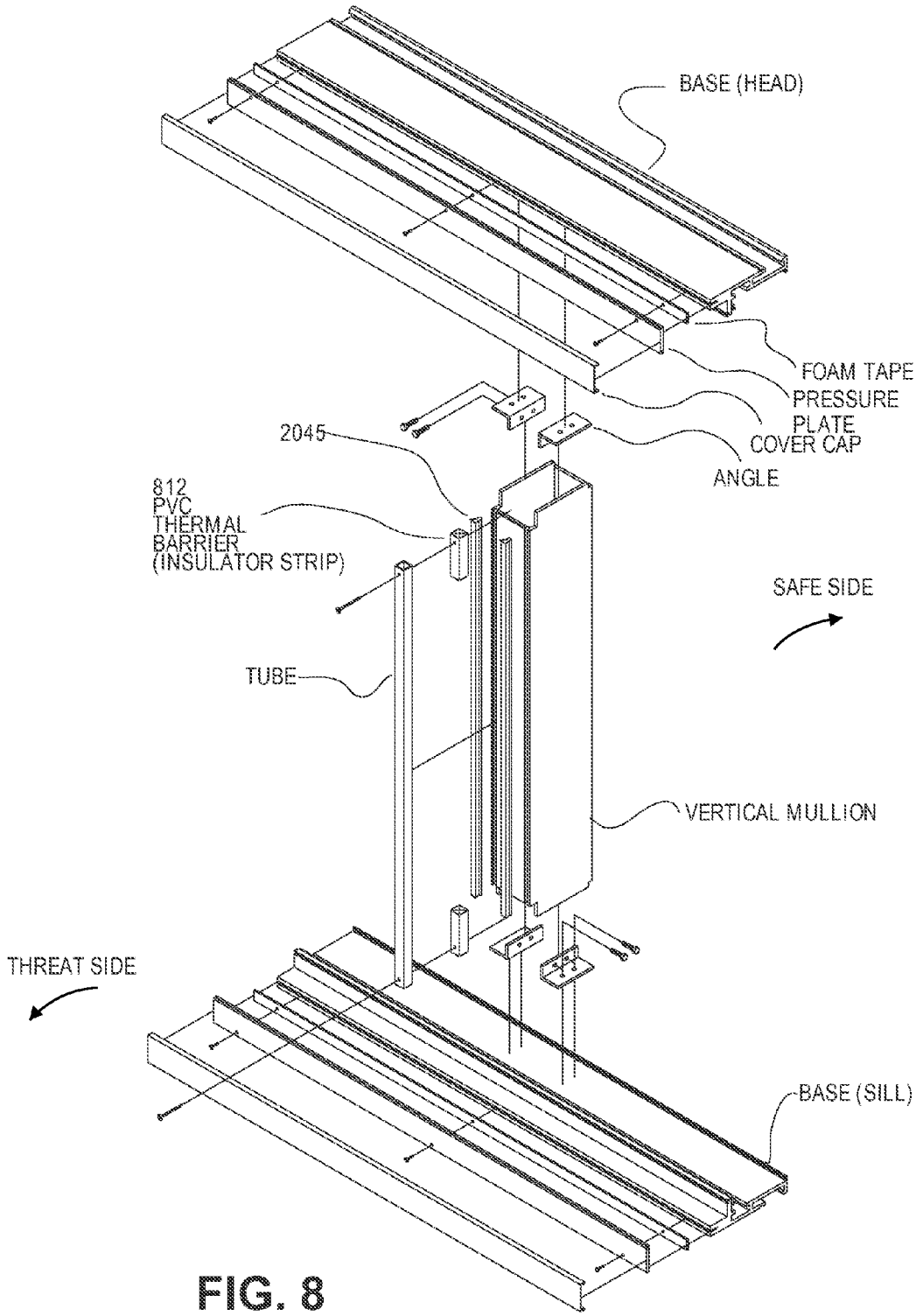
FIG. 8 is an isometric view of the mullion section.

Turning now to FIG. 7, the window 101 of FIG. 1 also has a vertical mullion between the glazing units 7, 8, depicted in FIG. 7 as a sectional view through plane 5. An isometric view showing how the mullion is joined with the head and sill sections is shown in FIG. 8. The glazing units 7, 8 are set against a rubber gasket 2045 that is inserted into a groove that runs the length of the mullion, on both sides. A tube 2048 may be sandwiched in between the glazing units, with foam backer rod and caulking on either side of it as shown. In addition, a PVC thermal barrier spacer (insulator strip 812) may be added between the tube and the mullion (see FIG. 8) to provide an additional thermal barrier to avoid sweating in the event the outside air is colder than the inside. Note how, in this case, there is no pressure plate that secures the glazing units. The pressure plate is not needed because the other three ends of each glazing unit 7, 8 are secured in place at the jamb, head, and sill sections. This allows the desirable failure mechanism of venting into the safe side from the mullion section, rather then at the perimeter of the frame.

To actually join and maintain the vertical mullion piece fixed, relative to the head and sill bases, a pair of L-shaped shear mounting brackets (also referred to as "angles") are attached. A first segment of each bracket is attached to the base piece (head or sill), while the second segment that is perpendicular to the first segment is attached to a side wall of the mullion, in both cases using a pair of screws as the preferred fastening mechanism. Other shear blocking techniques of fixing the mullion to the base and sill pieces may be used.

Figure 9:
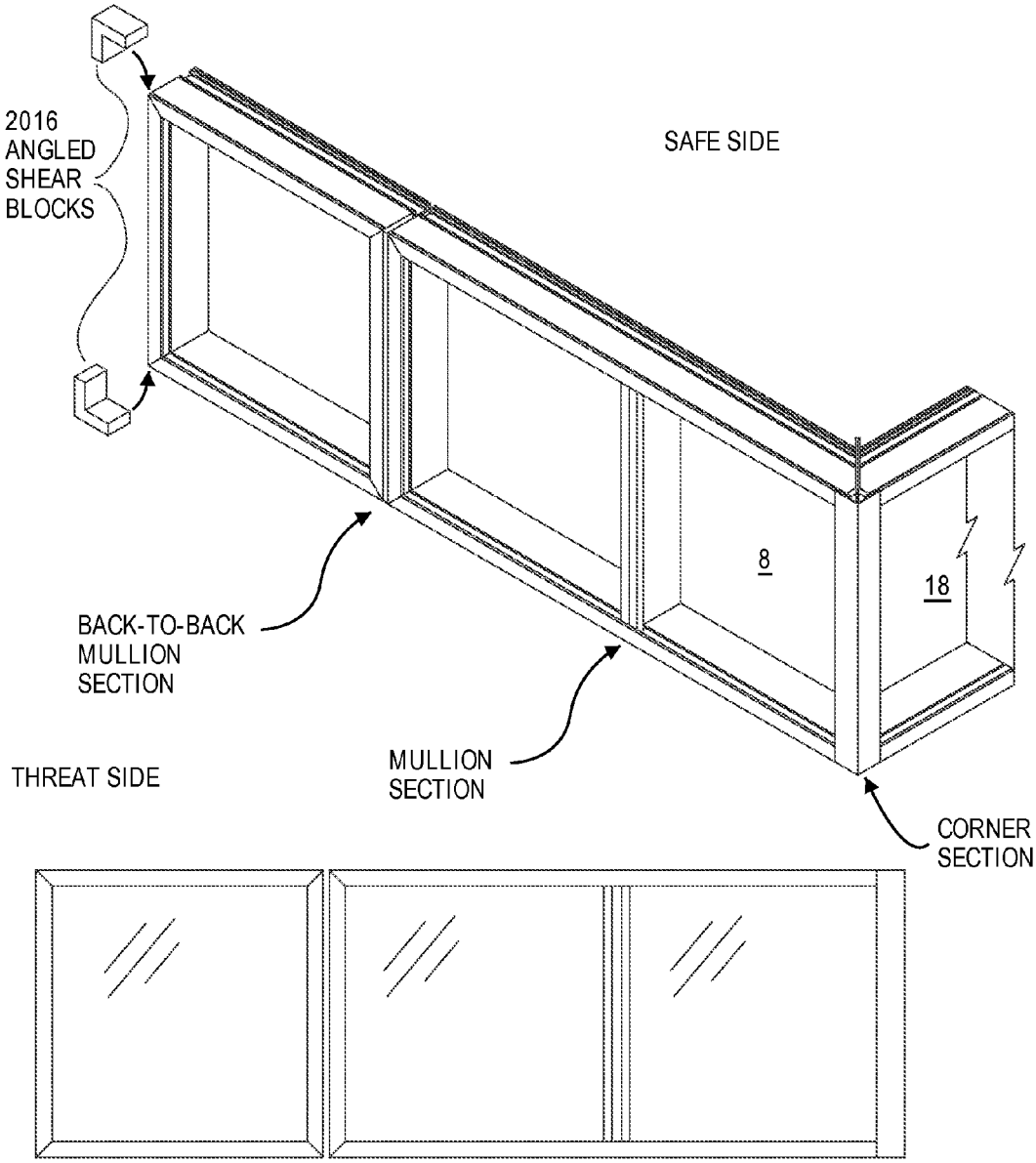
FIG. 9 is an elevation view of a window that changes planes at a corner section.
Figure 10:
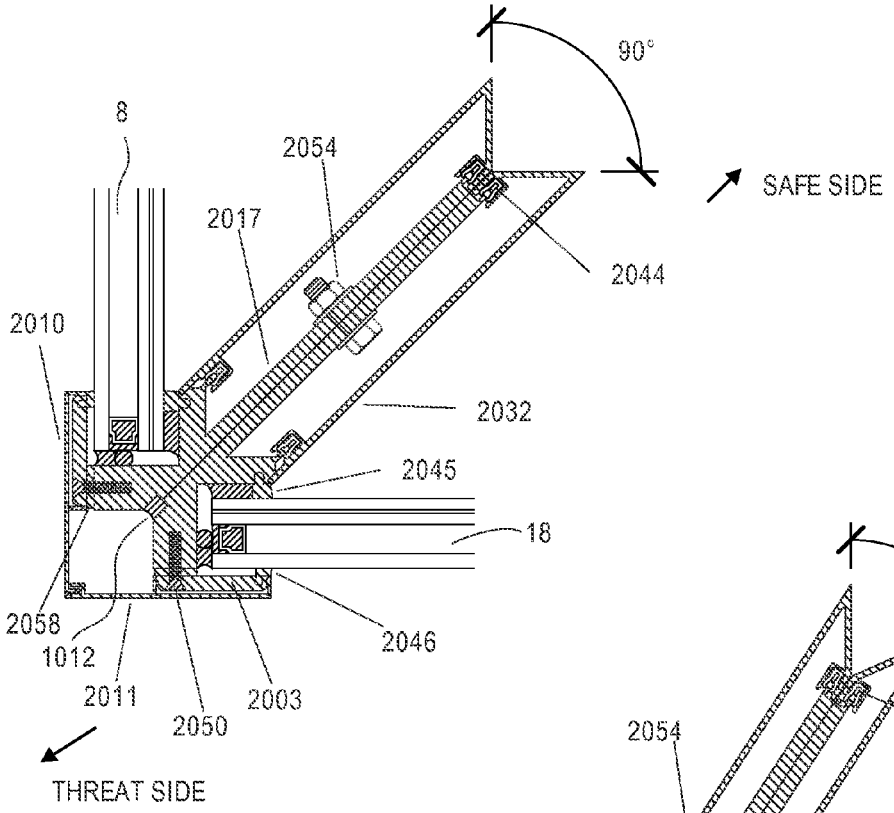
FIG. 10 is a sectional view of a ninety degree corner section.
Figure 11:
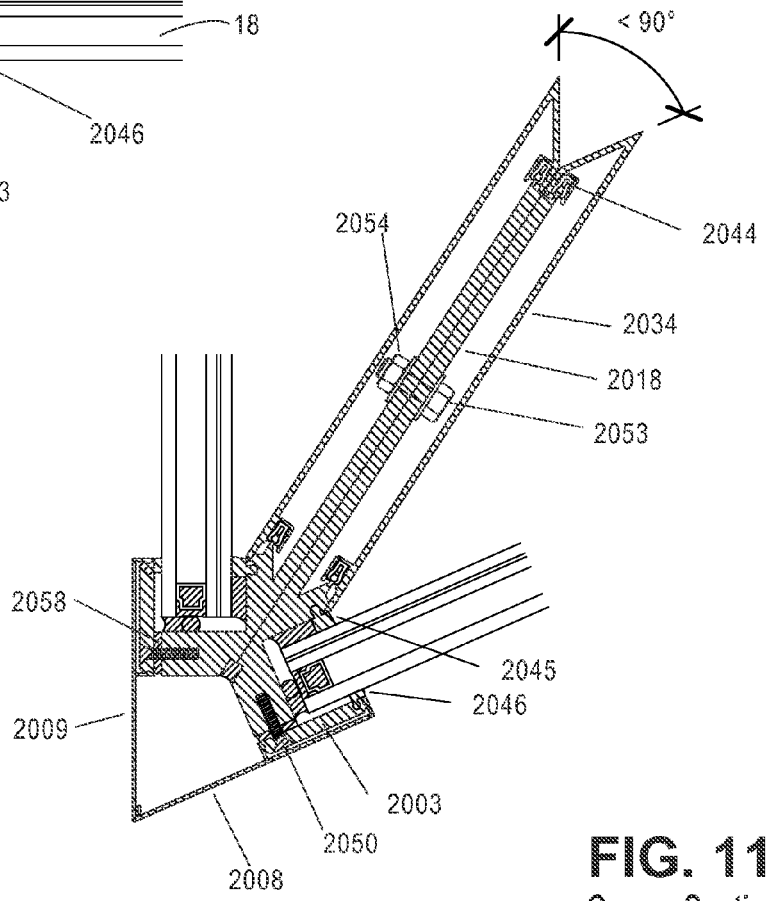
FIG. 11 is a sectional view of a less than ninety degree corner section.

Turning now to FIG. 9, an elevation view of a window application is shown in which the window makes a ninety degree change of plane at a corner. A sectional view of the corner section is shown in FIG. 10. The two glazing units 8, 18 are received by the respective L-shaped sections of pocketless bases 2017. These corner base pieces are slightly modified versions of the original base piece depicted in FIG. 2, where neither of the first and second pockets are formed. Sufficient resistance against an explosive blast from the threat side may be obtained (because of the depth of the pocketless base pieces) by butting together the pocket-less base pieces 2017, using a fastener mechanism, such as the nut and bolt condition 2054 as shown, every predetermined distance in the longitudinal direction (here, vertical). The glazing units are, in this embodiment, secured in the same way as before, namely fastening a pressure plate 2003 to the second segment of the L-shaped section that is in the near portion of the base. Cover pieces 2032 are snap fitted into place, to give a cleaner architectural look from the inside, as well as from the outside looking into the building. A similar mechanism as before, namely the integrally formed fingers on the base to which corresponding PVC clips on the cover clip, is used to secure the cover pieces in place. A pair of lengthened cover caps 2010, 2011 are snap fitted to the pressure plates on the threat side, to complete the aesthetic effect. Note that different versions of the pocket-less base may be extruded for different corner angles, as shown in FIG. 11 (an inside angle less than ninety degrees) and in FIG. 12 (larger than ninety degrees). The corner angle is the angle between the glazing units (as installed in their respective corner sections).

The corner section may also be provided with a pocket 1012 that runs the entire length of the abutting bases 2017. The pocket is formed by adjacent indentations coming together as shown, when the two base pieces are abutting each other. These indentations are formed integrally during the extrusion process, at the back of the L-shaped section of each base piece. The pocket 1012 may be filled with a sealant or adhesive, to prevent moisture from the threat side of the corner (which may be outdoors) from entering the safe side, which may be inside a building.

Figure 12:
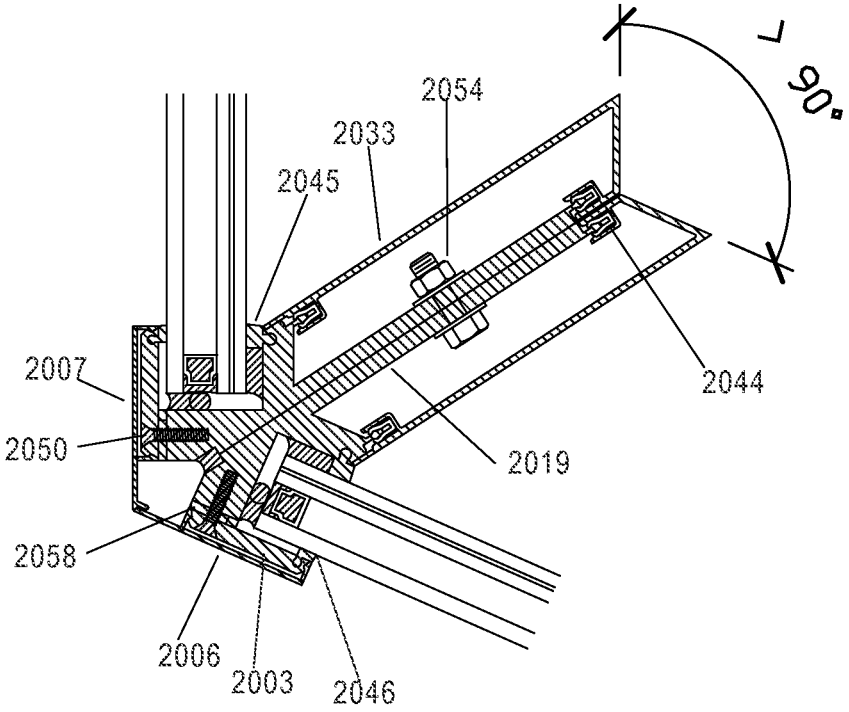
FIG. 12 is a sectional view of a greater than ninety degree corner section.
Figure 13:
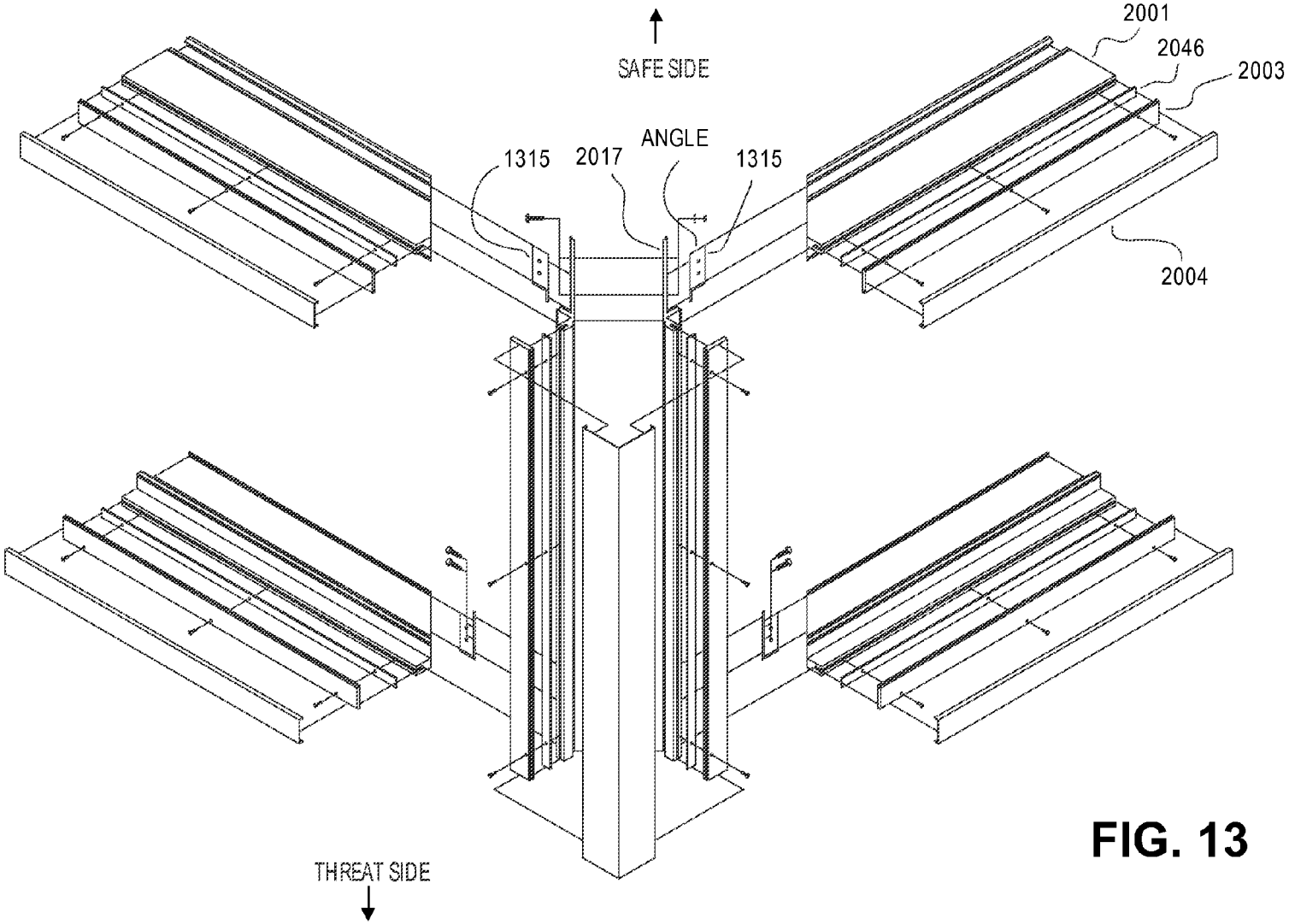
FIG. 13 is an isometric view of a corner section.

FIGS. 10-12 illustrate how the adjacent base pieces of a corner section may be joined and affixed to each other by a nut and bolt condition. Turning now to FIG. 13, this figure shows an isometric view of how the corner section is affixed to the head and sill sections. As shown, the head and sill sections each have a base 2001 with a corner section defined in the near portion to receive a glazing unit (not shown), a strip of high density closed cell thermal barrier tape 2046 against a pressure plate 2003 that secures the glazing unit in place, followed by, in some cases a pressure plate cover 2004 that may be snap fitted onto fingers integrated with the base (not shown) to hide the fastener mechanism used to secure the pressure plate to the base. To affix the base pieces 2017 to the head sections, a pair of L-shaped brackets or angles 1315 may be fastened to the far portions of the base pieces 1315 at one segment, and to the far portion of the base pieces 2001 at the other. Other techniques for rigidly fixing the base pieces of the corner section to the adjacent base pieces of a head (or sill) section may alternatively be used.

Having described an embodiment of the framing system and various techniques for assembling the different pieces together to assemble a window unit, FIGS. 14-18 illustrate several techniques for anchoring the window to the support structure of the building. As mentioned above, the support structure or substrate may be made of any one of different available materials, including, for example, concrete blocks, masonry, wood and/or steel. Beginning with FIG. 14, a sectional view of a sill section is shown. In this embodiment, the base 2001 is fitted with a base angle piece 2013 (or simply base angle, or angled base extension) that is L-shaped with first and second perpendicular segments. The first segment 1414 is shaped to mate with and slide into the first pocket of the base. For the purpose of anchoring, the second segment 1418 has multiple holes spaced in the longitudinal direction (perpendicular to the page), and a number of fasteners 1409 are used to anchor the frame through these holes to the building support structure or substrate 1416. In this case, the support structure is a concrete block and the fastener is one that is suitable for use with such materials. Note how in this embodiment, the base angle piece, and in particular its second segment 1418, is secured to a face 1410 of the concrete block that is parallel to the outside face 1412 of the concrete block. This should be compared with some of the other anchoring techniques described below.

Figure 14:
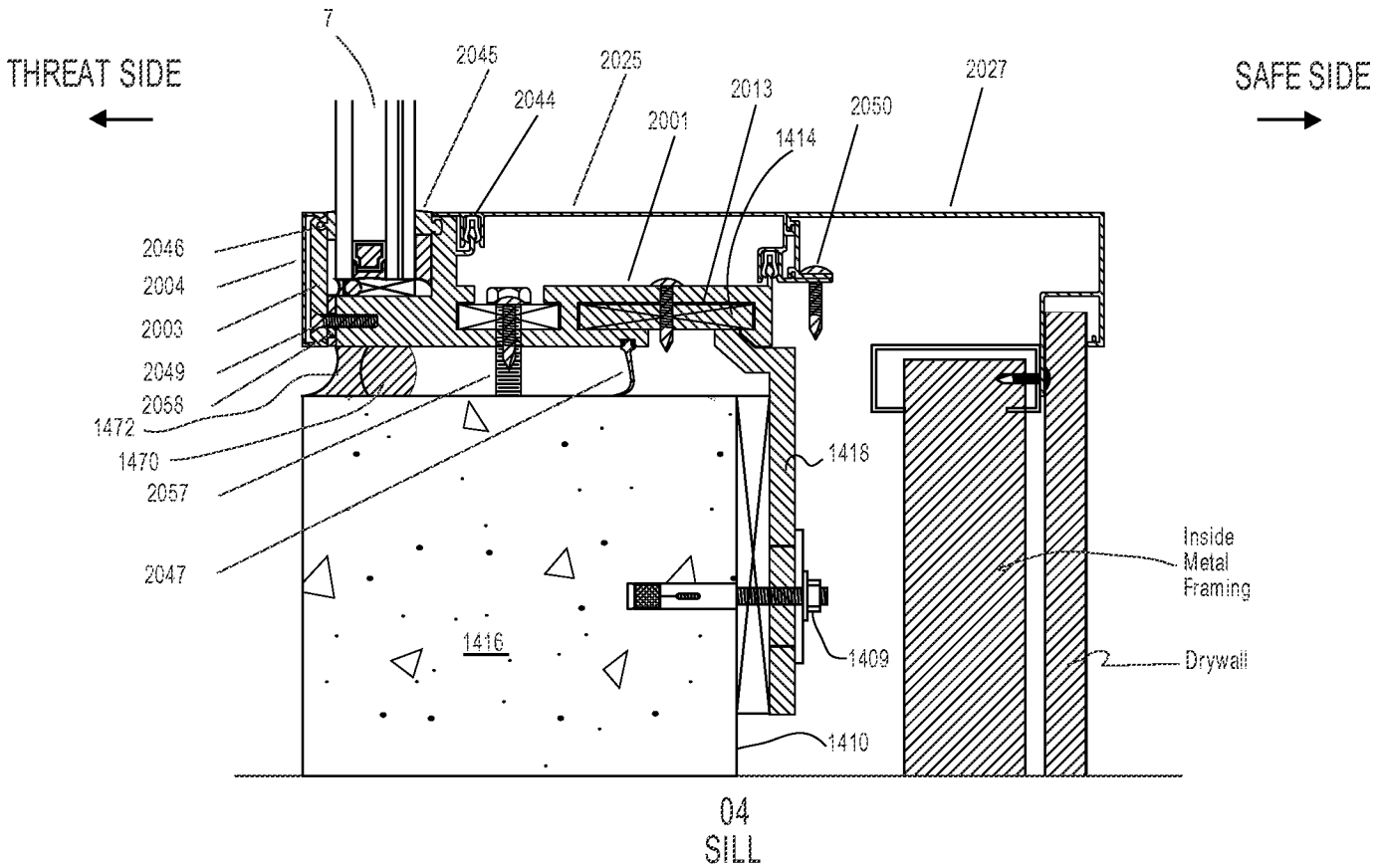
FIG. 14 is a sectional view of how the sill section may be anchored using a base angle piece as an extension of the base.

In addition to the aspects described above in FIGS. 2-6, the sill section in FIG. 14 also has a leveling bolt 2057 that, in this embodiment, is inserted through a hole in the middle portion of the base between the L-shaped section in the front and the first pocket in the back. This leveling bolt is used for plumb and square operations when the unit window is set into position within its opening. Once the window has been set into position, this leveling bolt may be tightened down so that when the window is released from the hold of a crane, for instance, the window stays level relative to the concrete block 1416 below it. There may be several such leveling bolts spaced longitudinally along the base piece 2001 of the sill section.

[It can be seen that most of the weight of the window is supported by the anchored, base angle piece 2013 and by the leveling bolt 2057, with very little being supported by the combination of foam backer rod 1470/caulking 1472. No additional spacer blocks are needed here between the base 2001 and the horizontal surface 1474 of the substrate 1416. Contrast this with the embodiment of FIG. 17 described below.

Still referring to FIG. 14, the cover pieces used in this embodiment is slightly different from the one for the jamb and mullion sections described above in FIG. 2-6, because in this embodiment, a stool condition is provided by a further cover piece 2027 or also referred to as an extension stool, to hide the anchor fastener 1409 from view inside the building. The extension stool 2027 in this embodiment fits over a section of drywall inside the building. The drywall is attached to, in this embodiment, inside metal framing that runs between the floor and ceiling of each story of the building and is used for purposes of attaching, for example, a piece of drywall. The near side of the extension stool is secured, in this embodiment, by a screw 2050 to a bracket formed integrally with the far portion of the cover piece 2025. Finally, it should be noted that although a sectional view of the head section is not shown, such a sectional view would be a mirror image of the sill section except for the absence of a leveling bolt which may not be necessary for the head section. An alternative substrate to the concrete block 1416 may be a pre-cast, stem wall, or other building support structure (e.g., a metal building with a fake masonry front, in which case the substrate would most likely be made of steel).

Figure 15:
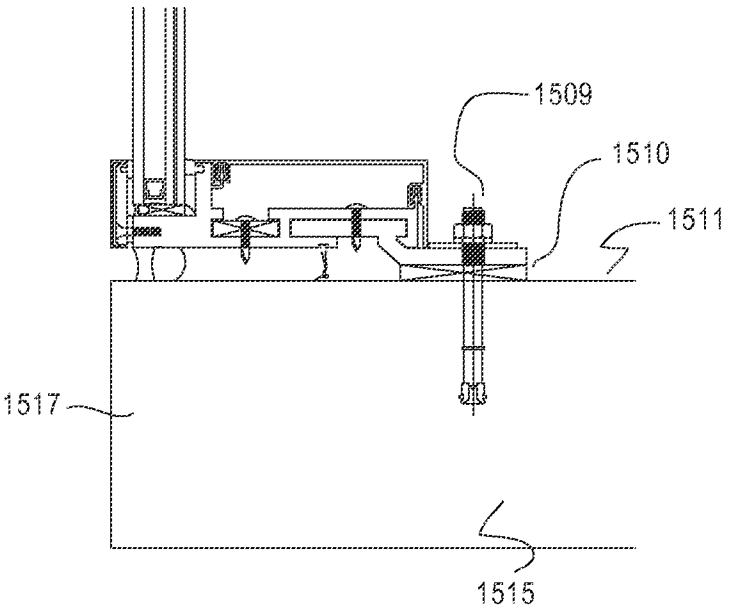
FIG. 15 is a sectional view of how the sill or head section may be anchored using a base extension piece that is not angled.
Figure 16:
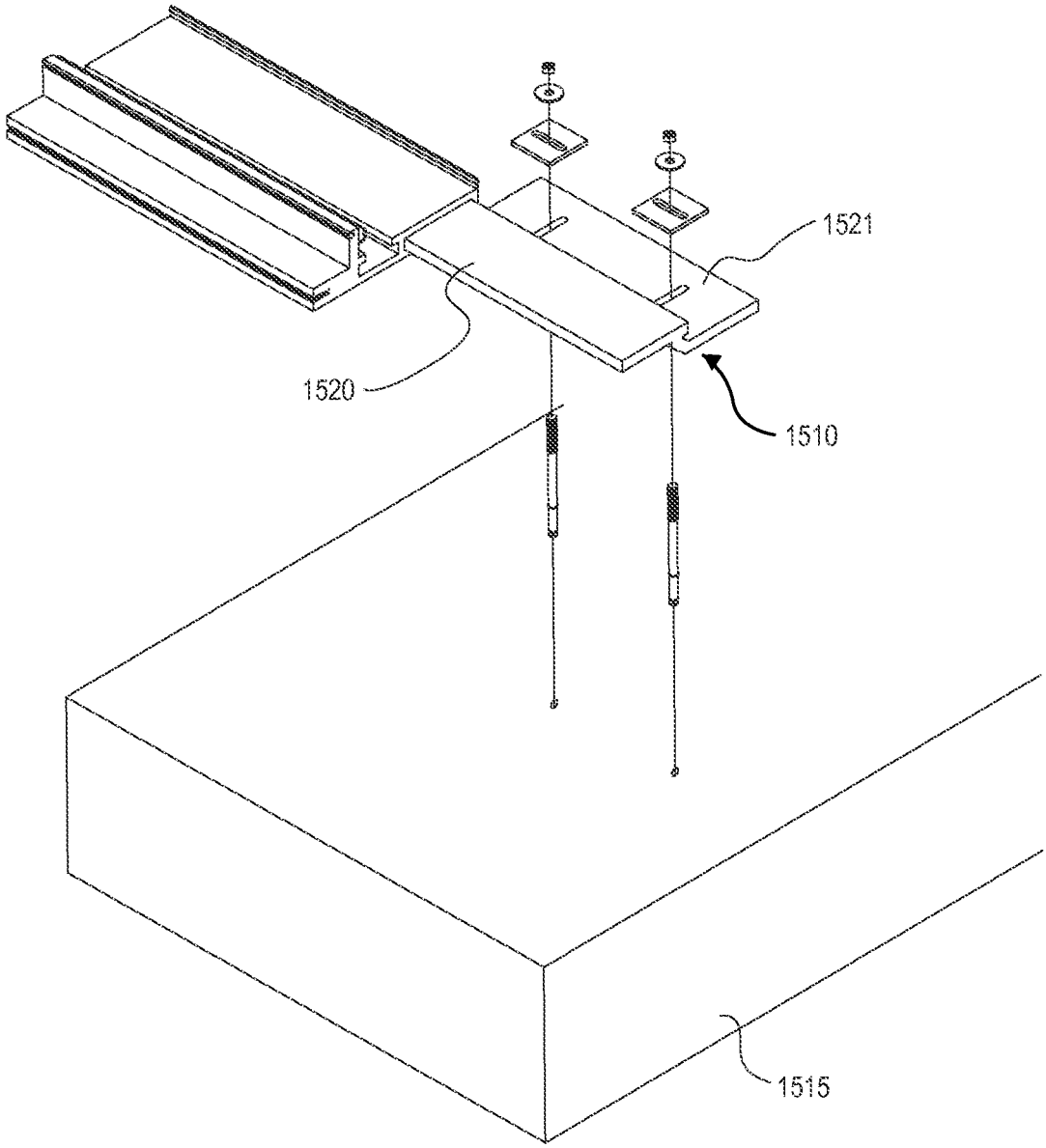
FIG. 16 is an isometric view of the anchored sill section.

Turning now to FIG. 15, an alternative anchoring mechanism is shown, where here the base extension piece 1510 does not have an L-shaped section. In this case, a fastener mechanism 1509 anchors to the horizontal surface 1511 of the substrate 1515, that is one that is perpendicular with the outside face 1517 of the building. The rest of the structure shown in FIG. 15 may be substantially identical to those described earlier, including the one for the sill section in FIG. 14, as well as those for the jamb and mullion sections in FIGS. 2-6. This would include the primary and secondary weather barriers, the manner in which the glazing unit is secured in place in the corner of the L-shaped section, the first pocket, the optional second pocket that features a further shear block, and the cover pieces that hide the fastener mechanisms used on the base piece. FIG. 16 illustrates an isometric view of this anchoring mechanism, where the base extension piece 1510 has a first segment 1520 that slides into the first pocket of the base and is held in place transversely (due to the shape of the pocket); the second segment 1521 is offset vertically from the first segment 1520, creating a gap between the base 2001 and the horizontal surface 1511 that is plugged with a primary weather barrier combination (e.g., a foam backer rod 1470/caulking 1472 as in FIG. 14).

Figure 17:
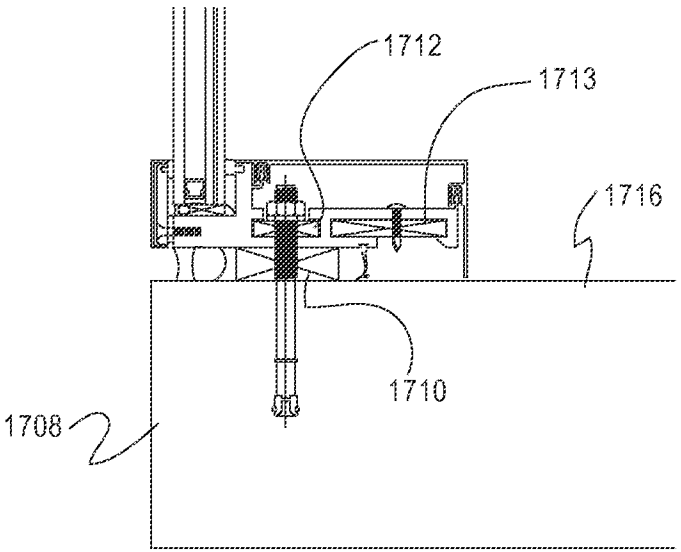
FIG. 17 is a sectional view of a sill section anchored without the use of the base extension piece.

Turning now to FIG. 17, yet another alternative for anchoring the window to the support structure 1708 of the building is illustrated, where in this case no separate base angle piece has been fitted into the first pocket of the base. Rather, the base is secured directly to the substrate (separated by one or more setting blocks 1710) via a fastener mechanism that anchors to the substrate through multiple holes spaced longitudinally in the first pocket. Note that in this case a shear block 1712 may be inserted into the second pocket as shown, to provide shear resistance. If additional shear resistance is desired, a further shear block 1713 may be inserted into the first pocket, as shown.

Unless otherwise specified, most of the anchoring mechanisms described here may be used for not just punched windows and strip windows, but also for curtain wall applications, as well. Also, it should be noted that a further difference between the anchoring mechanisms of FIGS. 15 and 17 is that the latter may provide less flexibility between the window frame and the building structure (due to the relatively close positioning of the anchor mechanisms to the glazing unit). This may be a concern in cases where significant expansion and/or contraction of the window is expected, because of the desire to avoid breakage of the glazing units.

Figure 18:
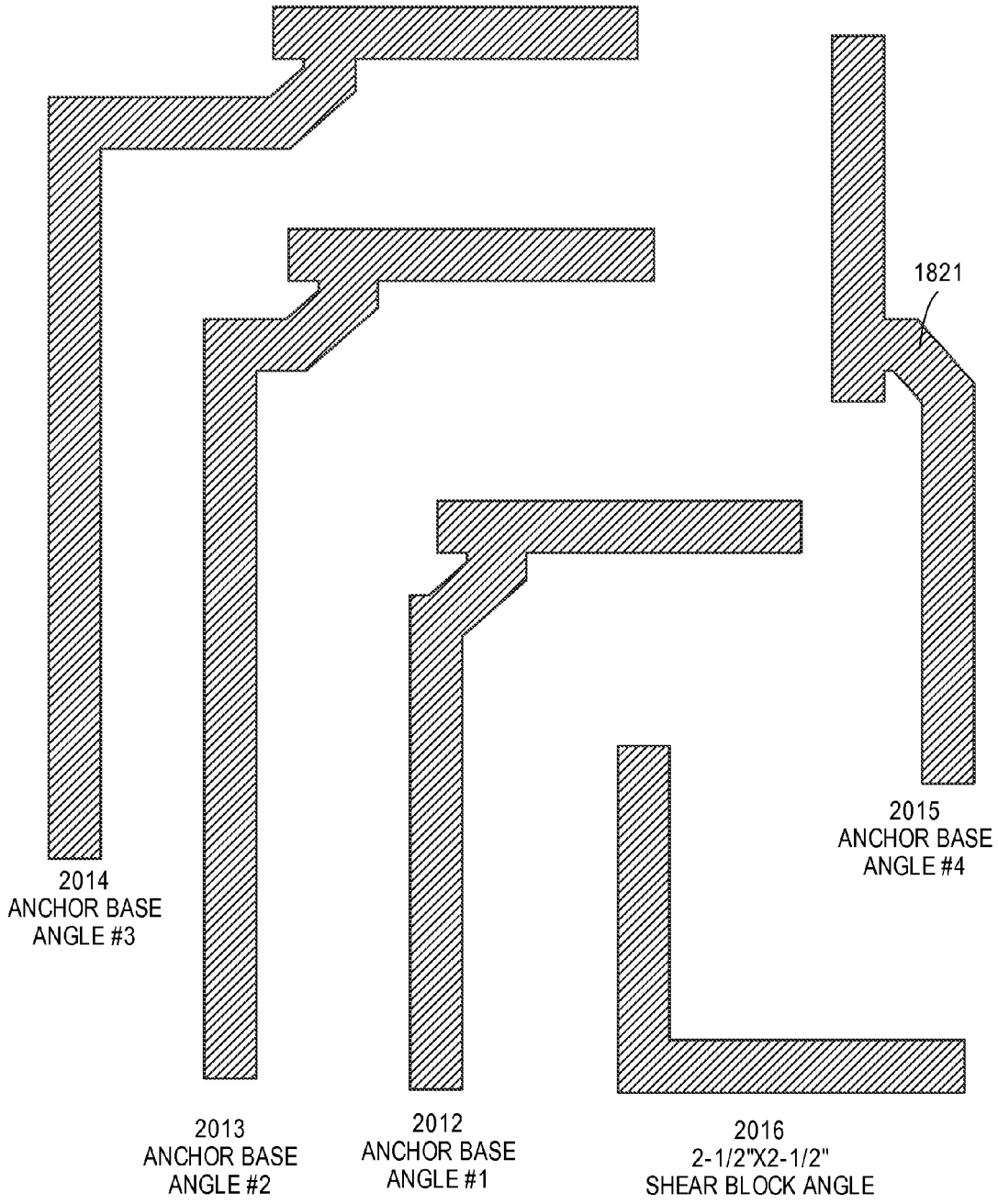
FIG. 18 depicts different types of base extension pieces for anchoring the frame, as well as a shear block angle used for joining a jamb section with a head or sill section.

FIG. 18 illustrates different types, including different sizes and shapes, of base extensions, used for anchoring the window to the support structure of the building. These pieces may provide greater resistance to shear if they are made of a relatively higher grade metal, such as 6061 T6 aluminum. As with the base and pressure plates, although these would preferably be made of a softer grade aluminum, the base extension pieces may be cut from extrusions.

Figure 19:
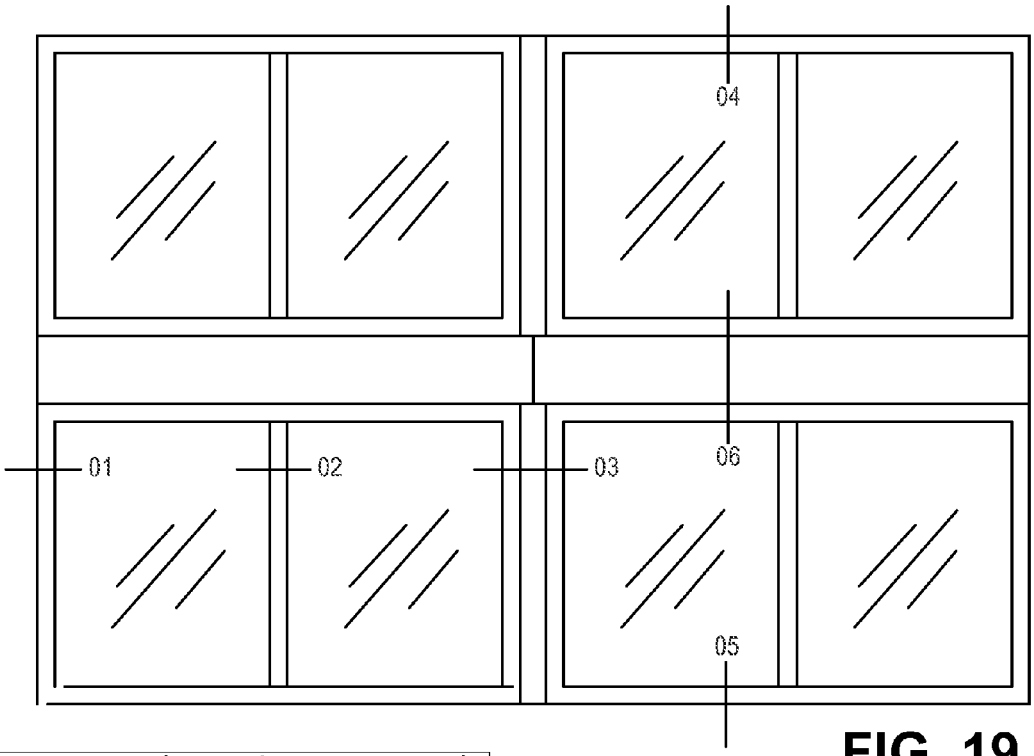
FIG. 19 is an elevation view of a window unit where more of the frame is visible.
Figure 20:
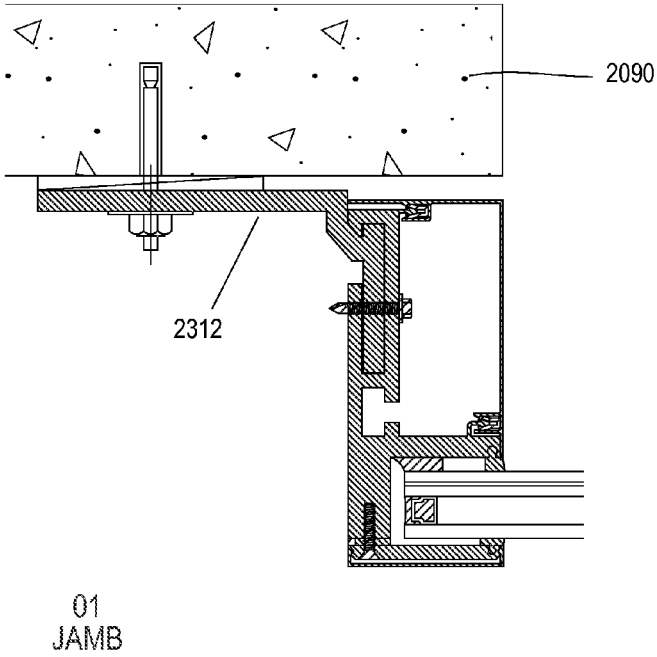
FIG. 20 is a sectional view of a jamb section.

Turning now to FIG. 19, another embodiment of a blast resistant security window is illustrated in elevation view. The view is from the threat side, for example, from the exterior of the building in which the window is installed. In this case, the window has four upper panes oriented horizontally, and four lower panes, where each pane may be a separate, security glazing unit. Beginning with FIG. 20, a sectional view of the jamb section is shown. The base used in this case has essentially the same cross-section as the one used in the embodiments described earlier, except for a difference in the depth of the base, resulting from a shorter, less deep second pocket. In contrast to the floating jamb of FIG. 2, the jamb in this case is anchored to the concrete block 2090 using the base angle piece 2312 inserted into the first pocket. Also, note how the frame of the window, in this embodiment, lies entirely in front, that is towards the threat side, of the support structure of the building. This embodiment, therefore, allows all of the frame to be visible from the threat side. This should be contrasted with another embodiment of the window frame illustrated in FIGS. 25-27B, where most of the frame is hidden behind the support structure of the building.

Figure 21:
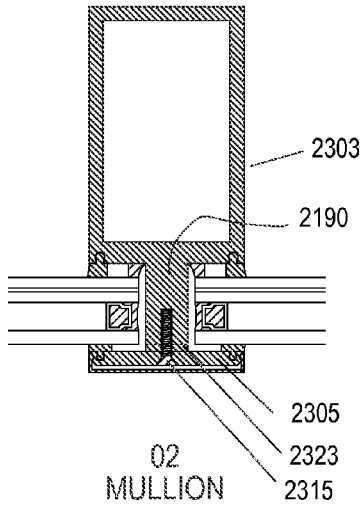
FIG. 21 is a sectional view of a mullion section using a pressure plate.

In FIG. 21, a sectional view of the mullion section is shown. This should be contrasted with the embodiment illustrated in FIG. 7, where the latter does not use a pressure plate to secure the glazings against the mullion base piece. In FIG. 21, a pair of back-to-back L-shaped sections are added to the mullion base 2303, resulting from the addition of a stem 2190 to the front of the basic, rectangular mullion base. The same mechanisms as described earlier for locating the glazing unit within the corner of the L-shaped sections, including the use of a seal between the glazing unit and the mullion base piece, as well as the addition of caulking and a strip of high density closed cell thermal barrier tape 2323 between the pressure plate 2305 and the glazing unit. A snap cover may be snapped onto the pressure plate as shown, to give a desired aesthetic look that hides from view the fastener mechanism 2315 used to secure the pressure plate to the stem 2190 of the mullion base piece.

Figure 22:
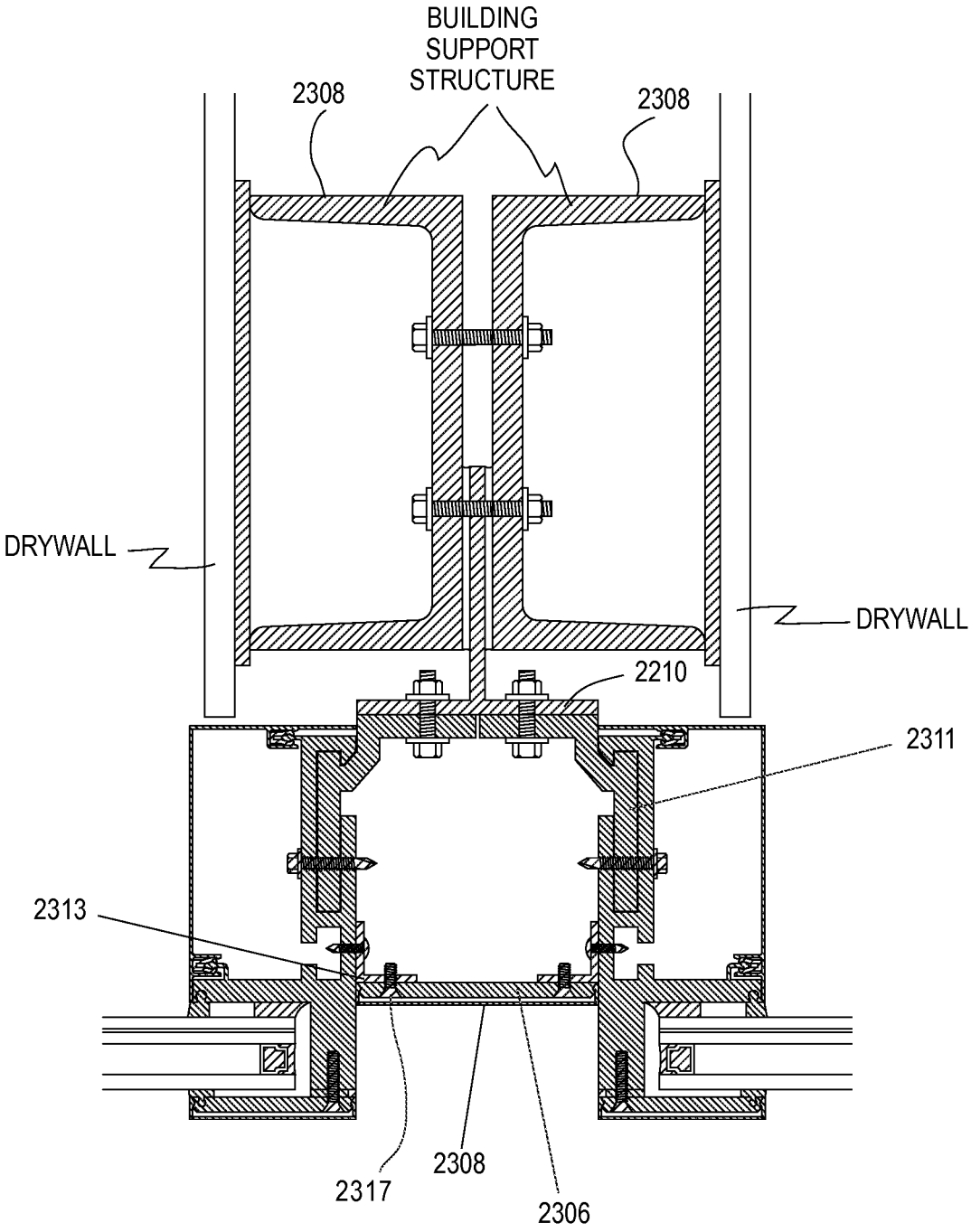
FIG. 22 is a sectional view of a double back to back mullion section of adjacent unitized windows.

The anchoring of this embodiment of the window may be achieved using a double mullion structure whose sectional view is shown in FIG. 22. This, of course, is in addition to the head and sill conditions shown in FIG. 23, described below. Referring to FIG. 22, the building structure in this embodiment has a pair of U-shaped structural angles 2210 that may be made of steel and that run vertically in the building, as shown. This may separate adjacent rooms, where pieces of drywall can be placed against the structural angles on opposite sides, as shown. A steel plate 2210 that runs vertically between the structural angles, and has a T-shaped cross-section in this case, is used for anchoring the window using the double mullion section. The double mullion section is composed of back-to-back oriented bases, each having a separate base angle piece 2311 inserted into the first pocket. The glazing units are, of course, secured in this example the same way as before in their respective corners of the L-shaped sections of their respective bases. In this case, the desired architectural look hides (from the threat side) the fastener mechanisms that anchor the base angle pieces to the T-shaped steel plate of the building structure, by fastening a panel 2306 to L-shaped brackets 2313 which are secured to the two bases that make up the double mullion. A cover 2308 snaps onto the panel 2306 to hide the fasteners 2317.

Figure 23:
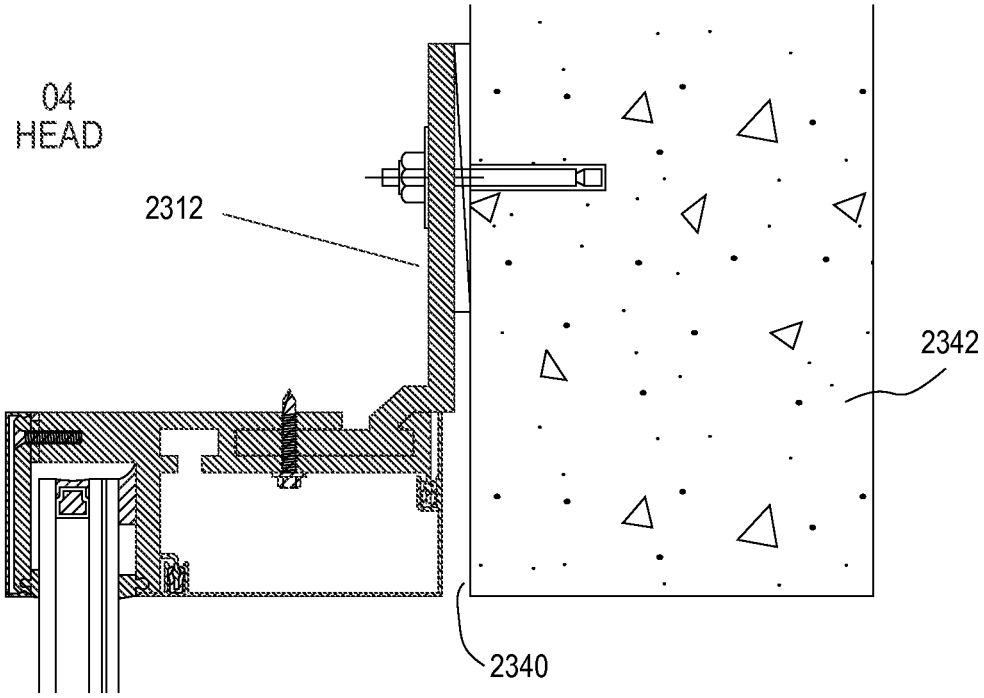
FIG. 23 is a sectional view of a head section.
Figure 24:
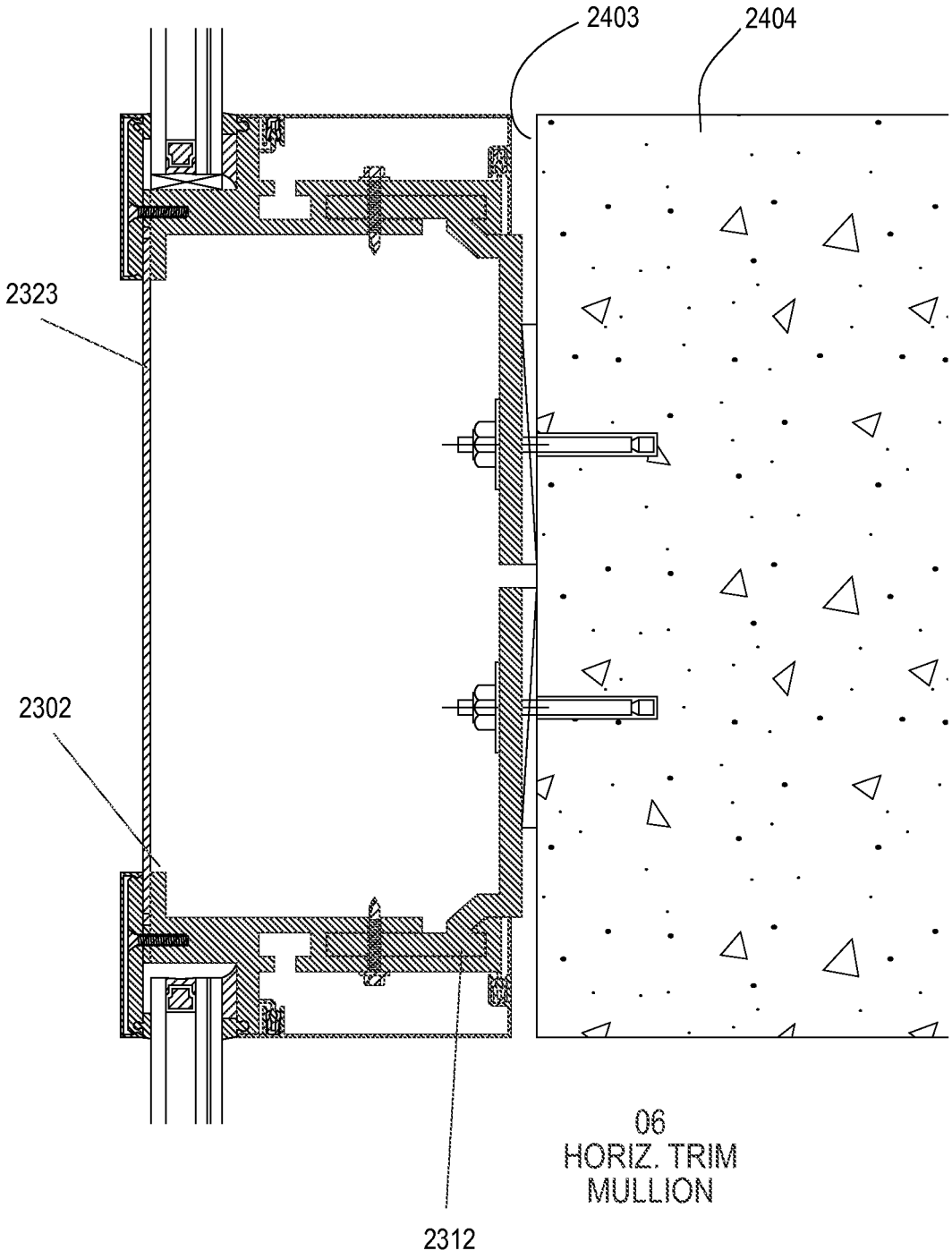
FIG. 24 is a sectional view of a horizontal trim mullion section anchored to the outside face of a support structure.

The window in FIG. 19, is also anchored at the head and sill sections, illustrated in FIG. 23. Although this figure only shows the head section, a similar view of the sill section is obtained by simply flipping FIG. 23 over a horizontal axis. In this embodiment, the base is anchored, once again, using a base angle piece 2312 that is L-shaped, with the second segment (through which multiple holes are formed) being directly secured to the threat side surface 2340 of a concrete block 2342 that is the building support structure in this case. Note how the frame in this embodiment is entirely visible from the threat side. Accordingly, if desired, additional stool conditions may be provided to hide the anchoring mechanism that secures the base angle pieces to the support structure of the building. An example of such a stool condition is illustrated in FIG. 24 which shows a horizontal mullion section of the window. There, an aesthetic cover panel 2323 is provided to hide the anchoring fastener mechanism horizontally along the window, and is held in position by being pinched between the pressure plate and the base piece for each side of the mullion. An additional finger 2302 may be integrally formed with each base piece as shown, and may also extend longitudinally the entire length of the base piece. It should be appreciated that in this case, the base piece and the pressure plate are otherwise substantially identical to those used in earlier described embodiments, except for perhaps a dimensional variation that may be necessitated by the underlying building support structure.

Figure 25:
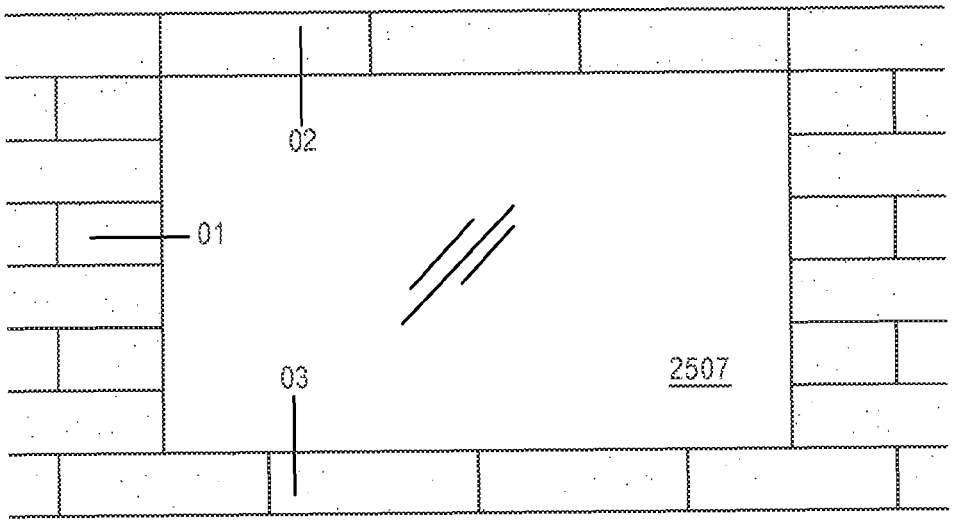
FIG. 25 is an elevation view of a four-sided opening within an existing wall of a building, containing a punch window whose frame is hidden.
Figure 26:
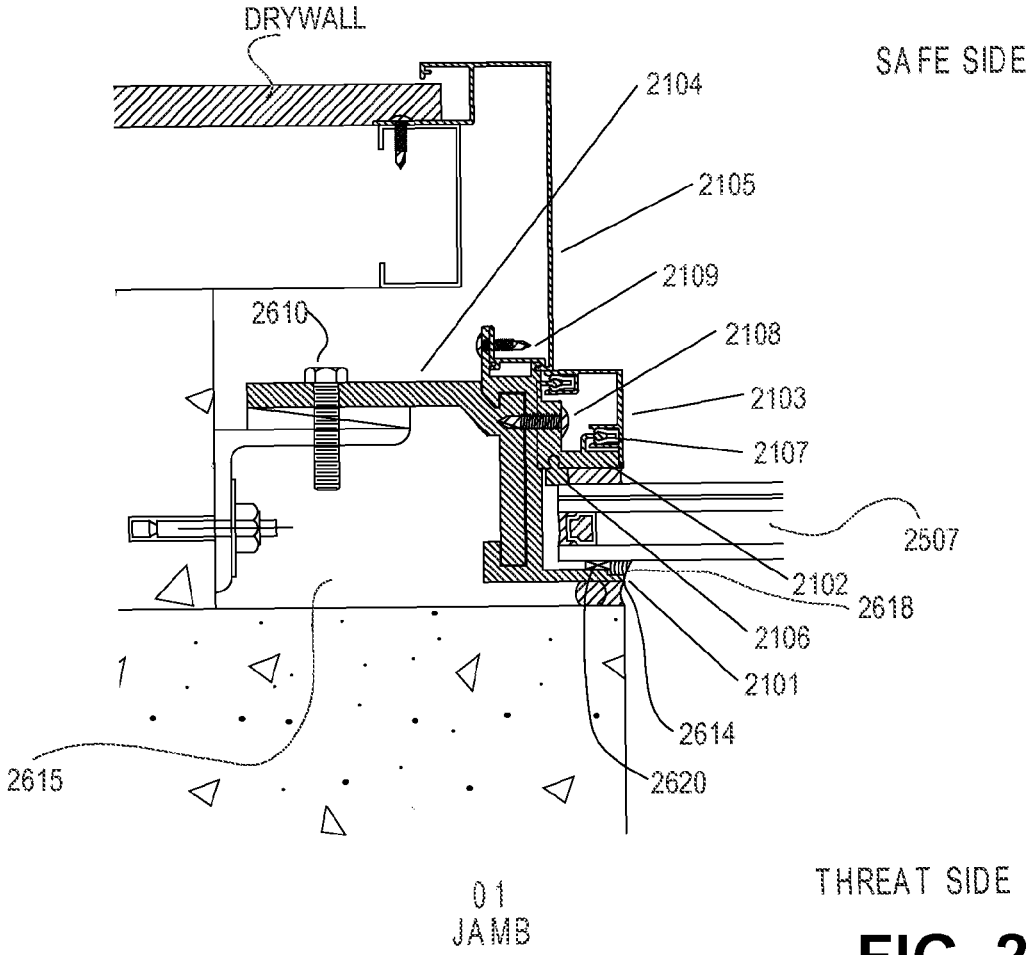
FIG. 26 is a sectional view of the jamb section of the punch window.
Figure 27A:
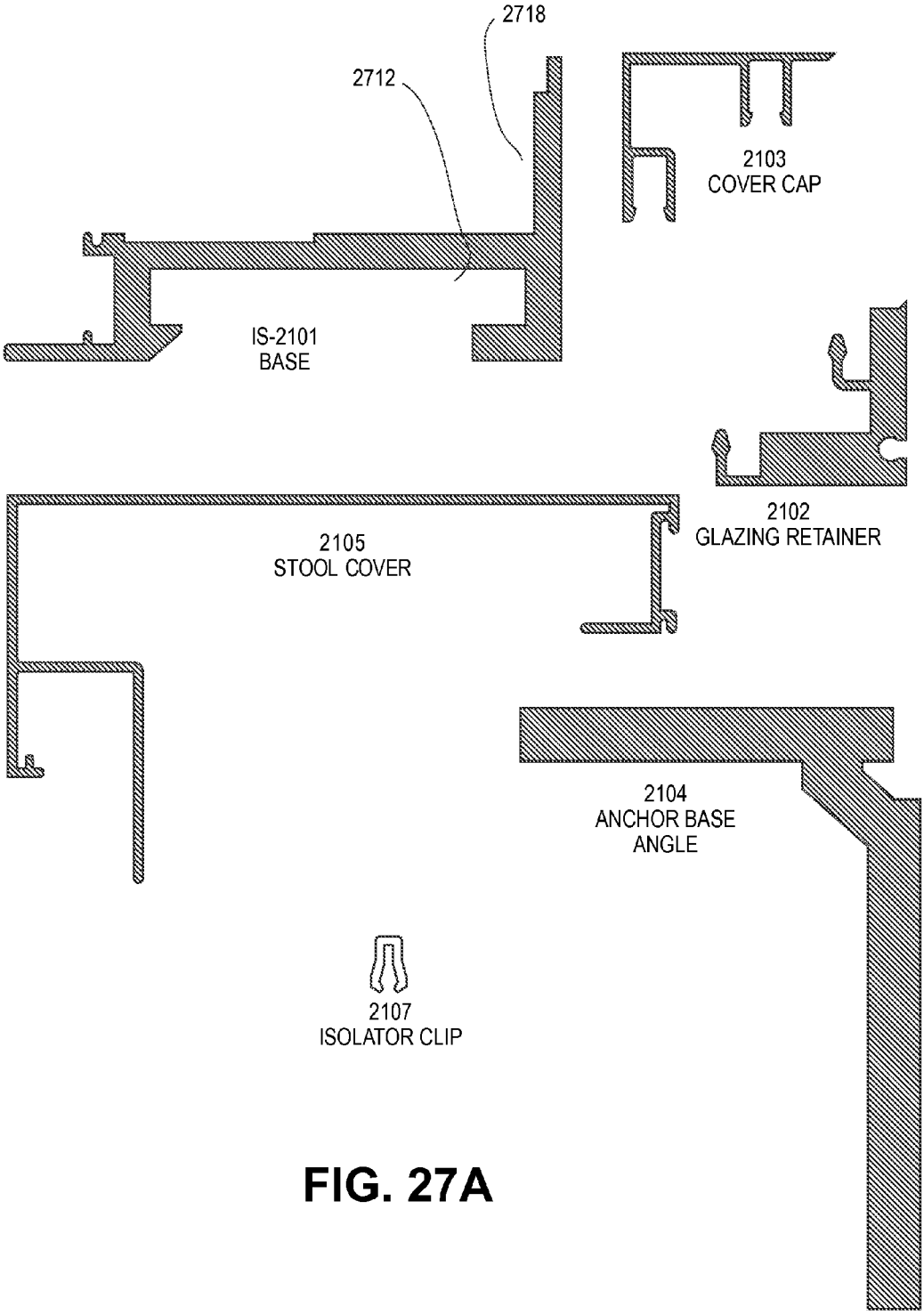
FIG. 27A depicts a base, glazing retainer, cover cap, isolator clip, anchor base extension and stool cover pieces used in the punch window.
Figure 27B:
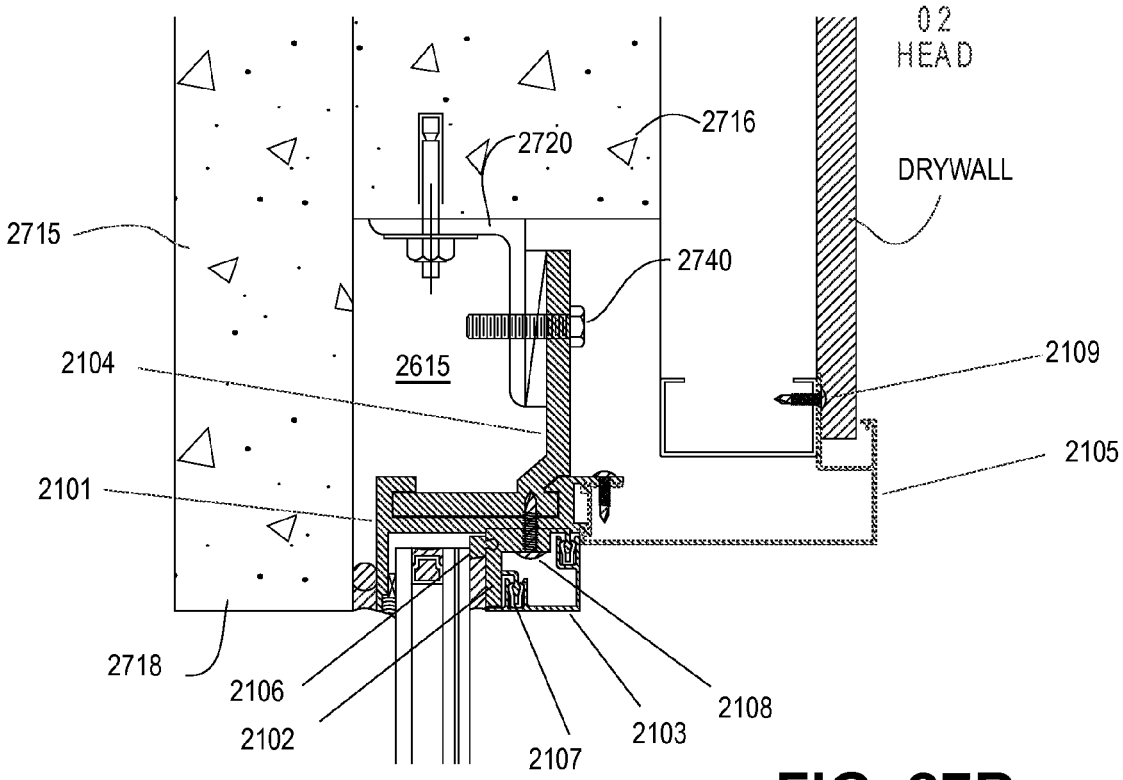
FIG. 27B is a sectional view of a head section of the window.

Turning now to FIG. 25, a punch window installed in an existing wall made of masonry or concrete blocks is shown. In this example, there is a step 2615 behind the front face of the building support structure, as illustrated in FIGS. 26 and 27B. This step allows the frame for the window to be inherently hidden from the threat side, behind the building structure. In contrast to the embodiments described above, however, the base piece 2101 in this embodiment is designed to receive the glazing unit 2507 from the safe side rather than the threat side. An expanded view of the base 2101, in this embodiment, is depicted in FIG. 27A. In this case, the base 2101 still has an L-shaped cross-section 2718 at a near portion, however, this time the L-shape section is oriented to receive the end of the glazing unit from the safe side of the window. As to the first pocket 2712, it is also designed to receive a base angle piece 2104 used to anchor the frame, however, the first pocket 2712 is formed closer to the L-shaped section 2718, in the near portion. A glazing retainer 2102 that is fastened to the base holds the glazing unit in place against, for example, a seal 2106 made of EPDM or other high durometer material, and caulking that is run all the way around the periphery of the glazing unit. Note how the glazing retainer 2102 is secured to a far portion of the base, in contrast with the earlier embodiments in which the pressure plate is secured to the near portion. A cover piece 2103 may also be provided in this embodiment, to hide from the safe side the fastener mechanism that is used to secure the glazing retainer in place. In view of the stepped building support structure for this embodiment, a further stool cover 2105 may be provided that hooks onto the far end of the base as shown, at one side, and to a drywall support on the other, so as to hide from view (on the safe side) the anchor fastening mechanism 2610. Lastly, a notch 2614 in the outer most edge of the base 2101 helps keep a heal bead 2618 in place against a double sided foam tape backer 2620, between the base and the glazing unit, to further improve weather sealing.

Finally, the sill and head sections of the window are illustrated in FIG. 27B (where the latter only shows the head section, with the sill section being understood to be a mirror image thereof). The pieces that make up the head section are again located behind a first concrete block 2715 that may be at the outside of the building, next to another concrete block 2716 which falls short of the end surface 2718 thereby creating the step 2615 in which the frame is located. The frame anchoring mechanism in this case involves a base angle piece 2104 whose first segment is inserted into the pocket of the base piece, and the second segment is attached to another L-shaped bracket 2720 by multiple bolts 2740. The L-shaped bracket (that may be made of steel) has its other segment fastened to a face of the second concrete block 2716 that is perpendicular to the front face of the building. A similar cover cap and stool condition 2103, 2105 are used with the head section as was used with the jamb section depicted in FIG. 26.

Figure 41:
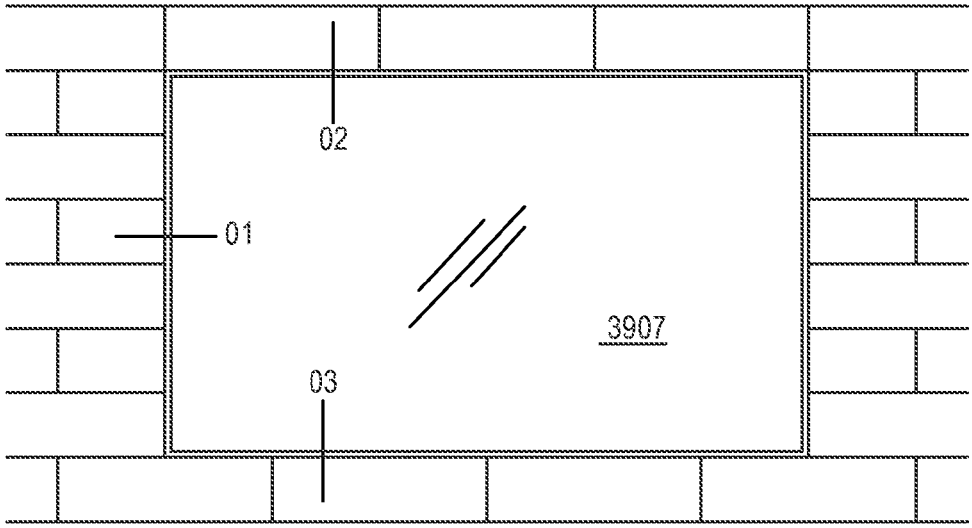
FIGS. 41-43 show another punch window unit installed, showing the frame from the threat side.
Figure 42:
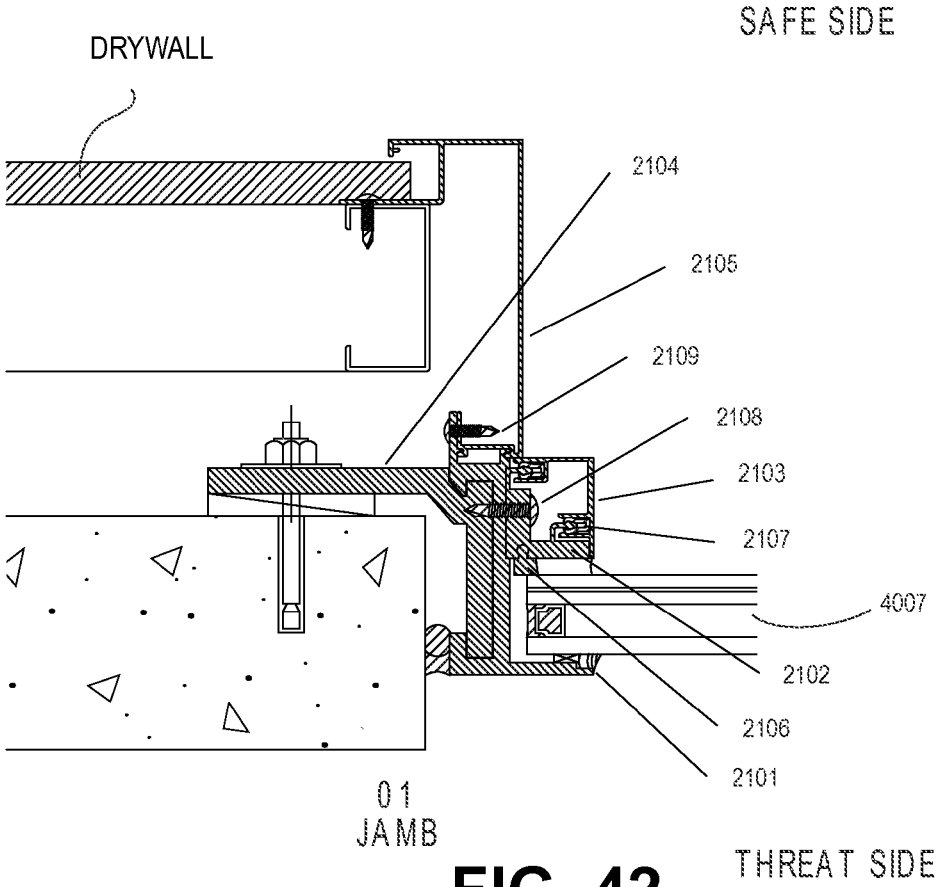
Figure 43:
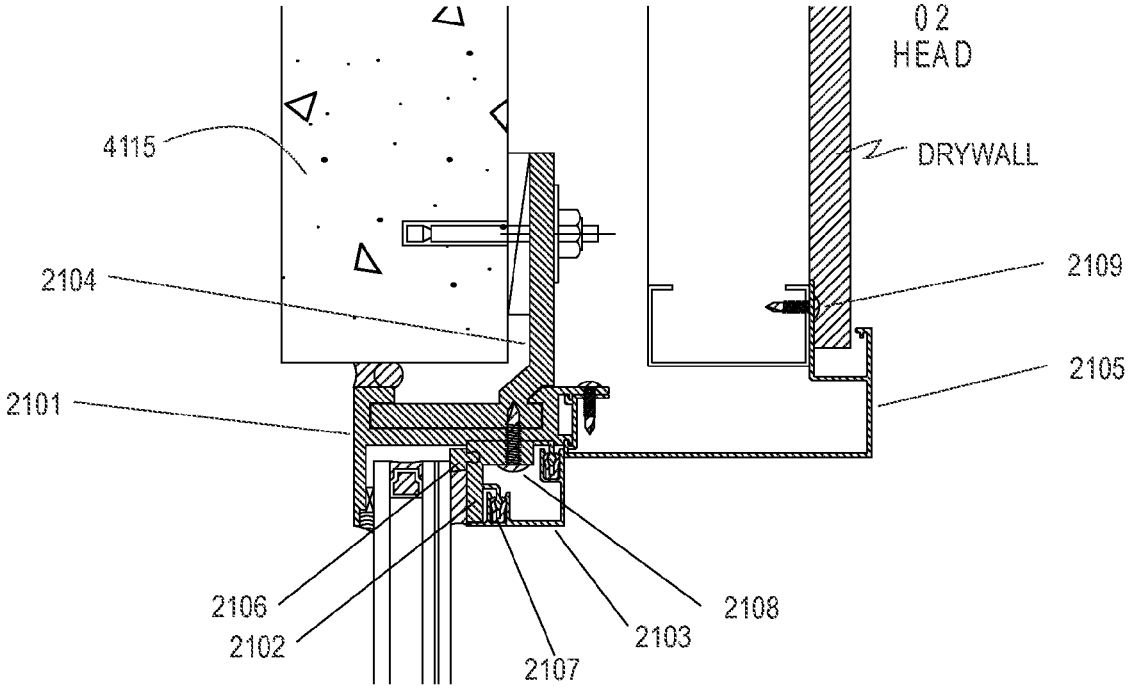

Another version of a punch window unit is shown in FIGS. 41-43, having a frame that is similar to the one in FIGS. 25-27B. A difference however is that the former is anchored differently so as to show some of the frame to the threat side.

Figure 28:
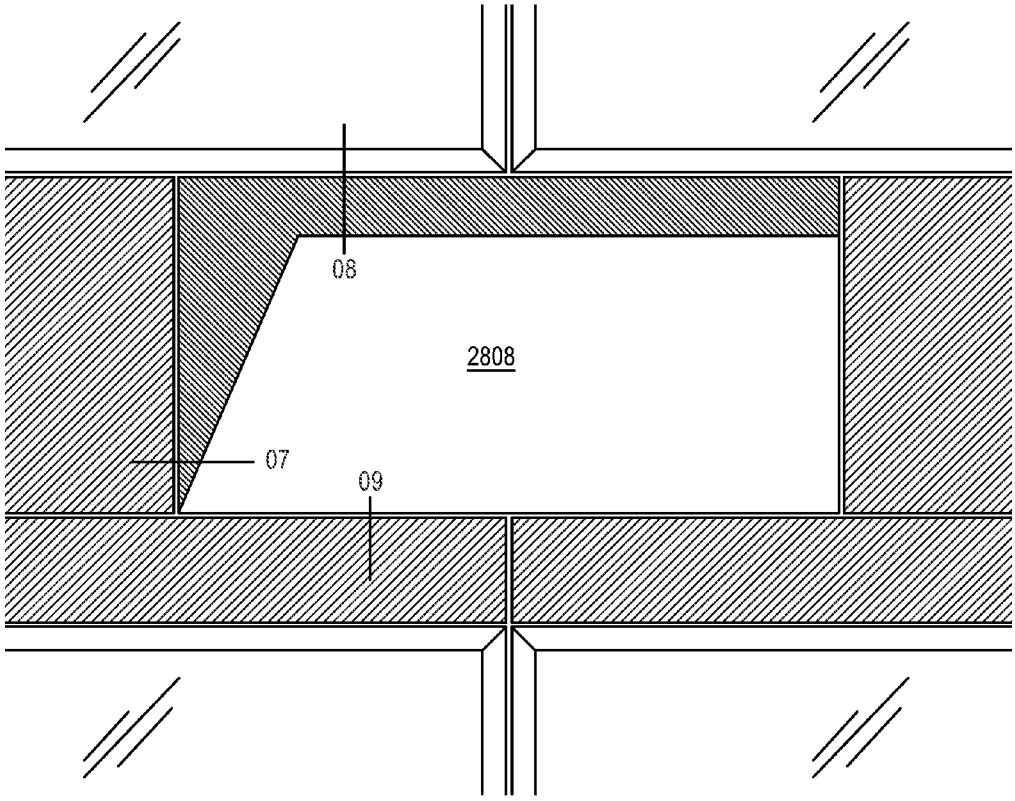
FIG. 28 is an elevation view of an aesthetic, shadow box suitable for the exterior of a building.
Figure 29:
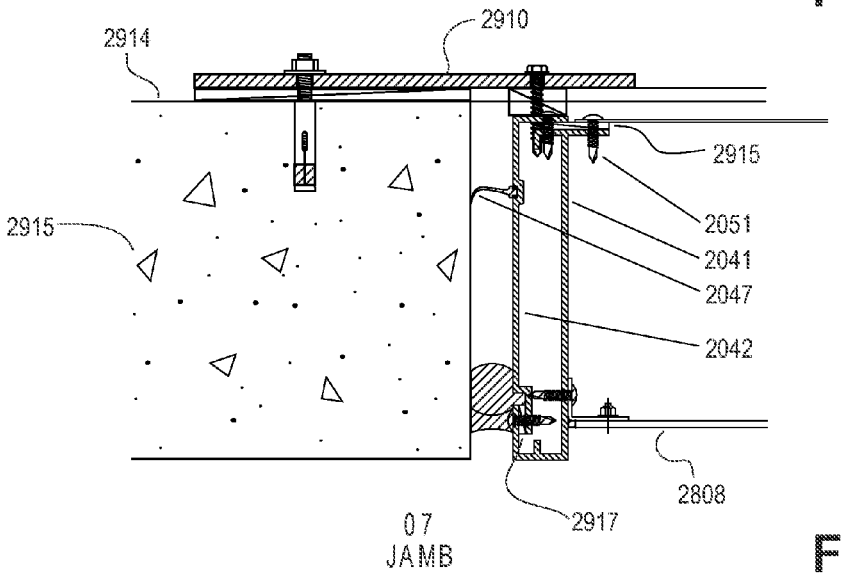
FIG. 29 is a sectional view of a jamb section of the shadow box.
Figure 30:
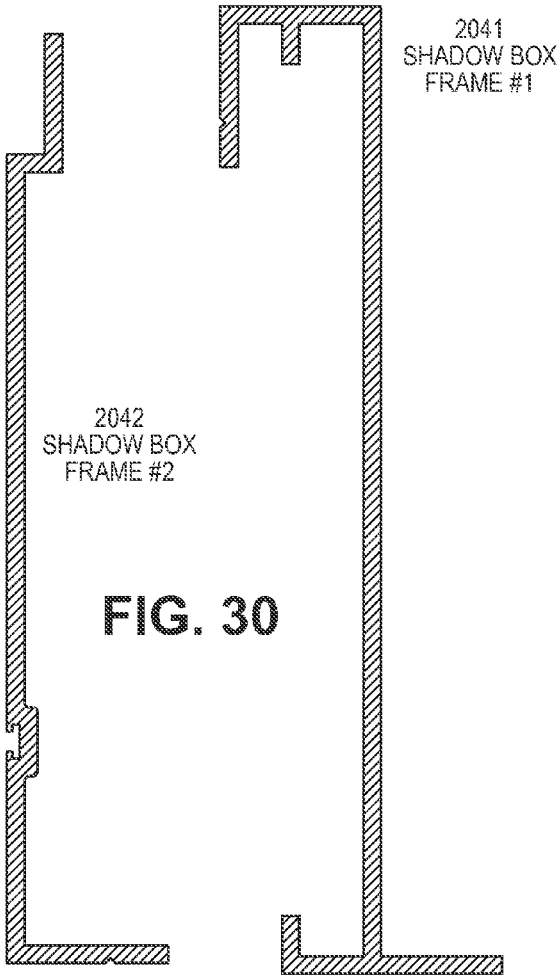
FIG. 30 shows two different shadow box frame pieces used to form the shadow box.
Figure 31:
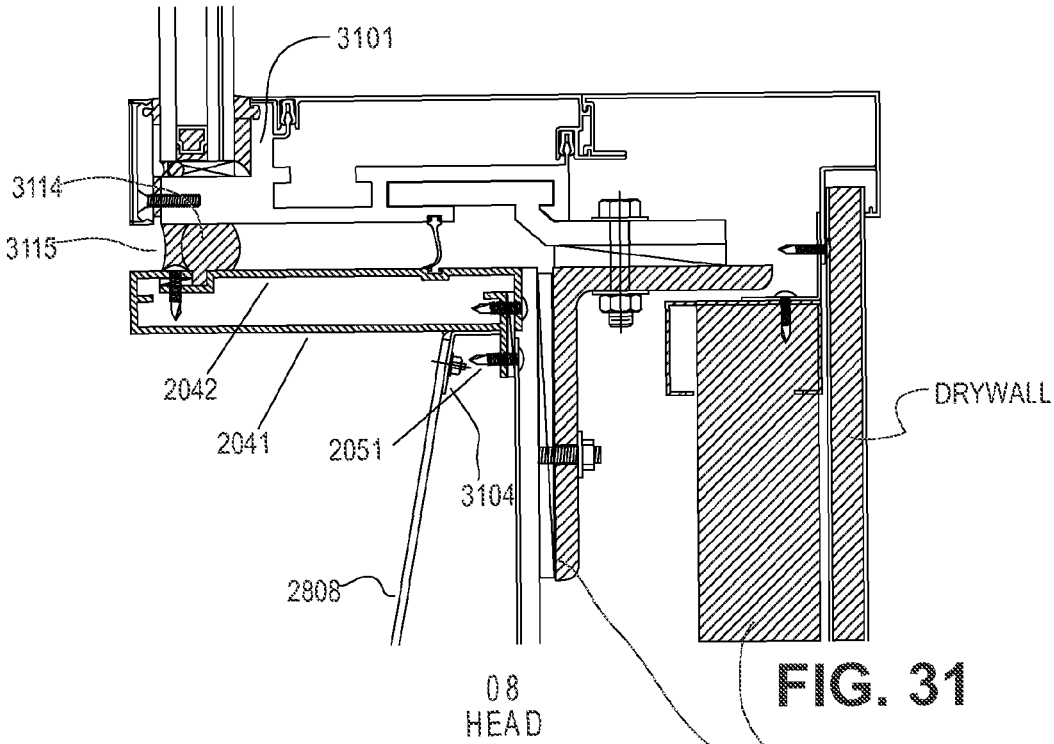
FIG. 31 is a sectional view of a head section of the shadow box.
Figure 32:
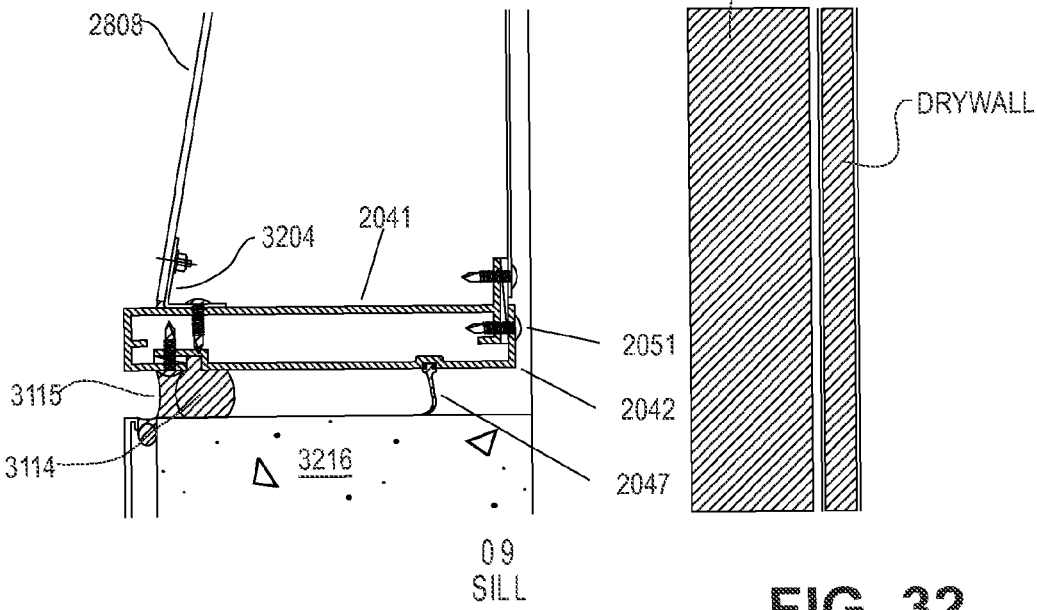
FIG. 32 is a sectional view of a sill section of the shadow box.

Turning now to FIG. 28, an elevation view of an aesthetic feature, one that is designed to mitigate explosive blasts, is shown. This is also referred to as a shadow box, giving the appearance looking from the threat side of a hopper, swing-in window that has been opened. This "fake" window has a jamb section as illustrated in FIG. 29, including two extruded pieces, referred to as shadow box frame 2041 and shadow box frame 2042. These pieces are secured to each other along two rows of screws as shown, one row positioned near the front end of the fake window (closer to the threat side) and another row positioned at the back end (closer to the safe side). Sectional views of these two shadow box frame pieces are shown in FIG. 30. The frame 2042 is secured to a back plate 2910 which in turn is anchored to back surface 2914 of a concrete block 2915. A simulated glazing unit 2808 (which need not be of the same type as those used in the actual windows described above) is attached at its ends to the front portion of the frame combination shadow box frames 2041, 2042. The orientation of this glazing unit, namely its angle relative to the face of the building, is illustrated in FIG. 31 which shows a sectional view of the head section. The bottom of the shadow box, that is the sill section, is depicted in FIG. 32. Note how the glazing unit 2808 is angled from the vertical, by being rigidly secured via angled brackets 3104, 3204 that are located near the back end of the head frame piece 2041 (FIG. 31) and the front end of the sill frame piece 2041 (FIG. 32). Note also the primary weather protection mechanism of the foam backer road and caulking combination 3114, 3115, sealing the gaps between frame pieces 2041, 2042 and a base piece 3101 (head, FIG. 31) and the building support structure 3216 (sill, FIG. 32).

Figure 35:
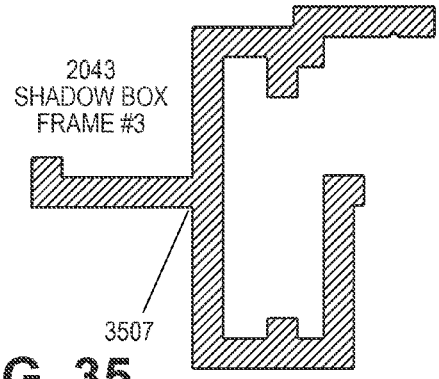
FIG. 35 shows a shadow box frame piece.
Figure 33:
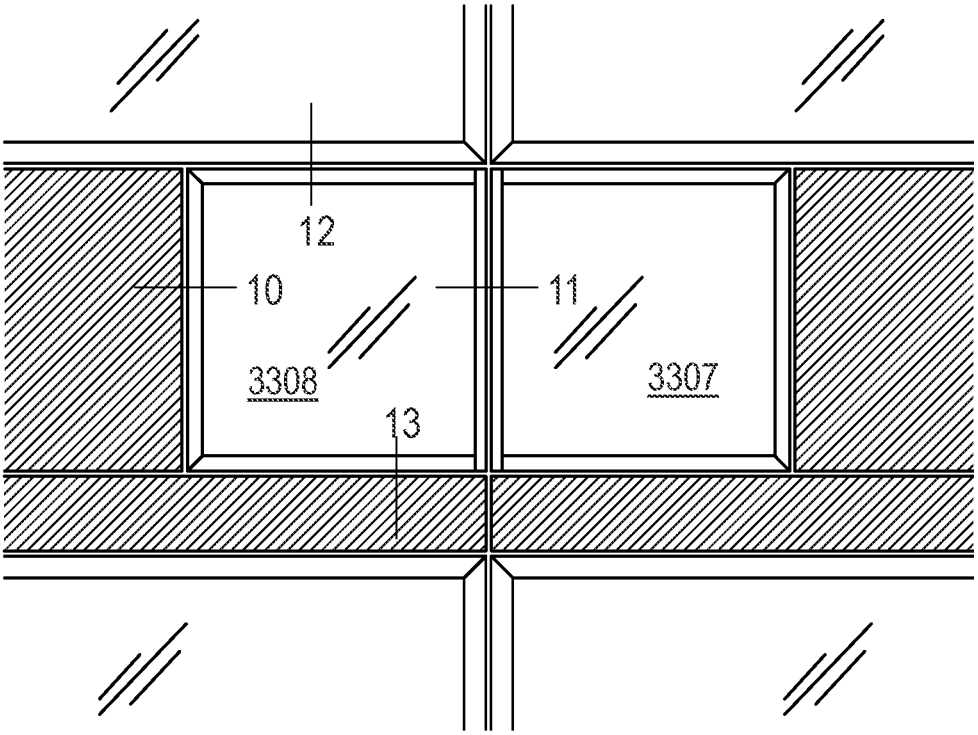
FIG. 33 is an elevation view of another style of shadow box suitable for use in an atrium of a building.
Figure 34:
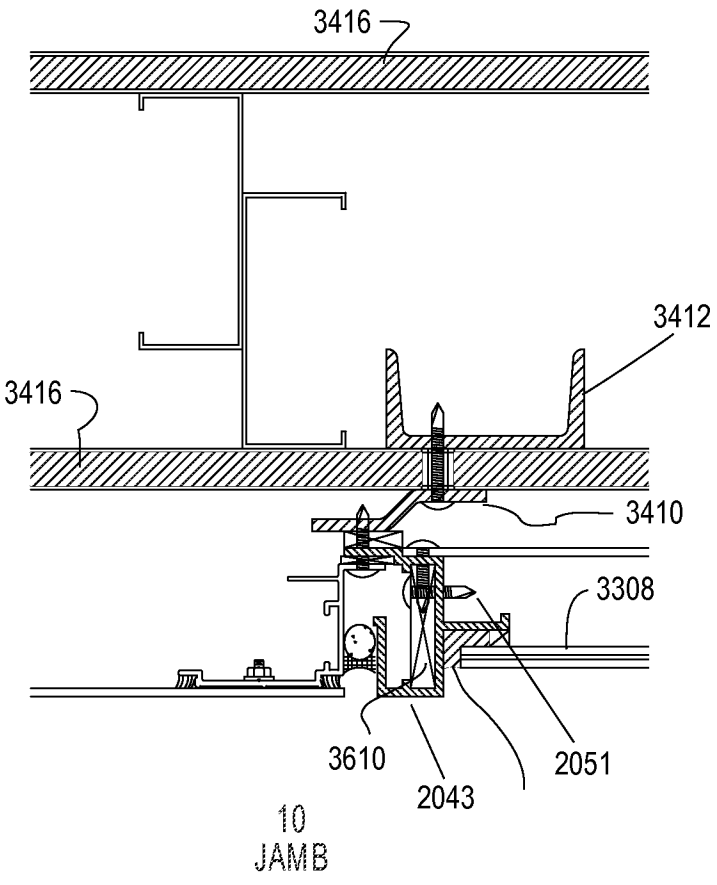
FIG. 34 illustrates a sectional view of the jamb section of the shadow box.

Another type of shadow box is shown in FIG. 33, where in this case, the fake window is designed to be used in the atrium of a building. In this embodiment, the shadow box may mitigate against explosive blasts aimed at the atrium from the inside of the building. A jamb section is illustrated in FIG. 34. The shadow box frame piece 2043 used in this embodiment is illustrated in FIG. 35. Once again, the frame 2043 has an L-shaped section 3507 at the near portion (closer to the threat side) oriented to receive a glazing unit from the threat side. Still referring to FIG. 34, the shadow box frame 2043, in this embodiment, is anchored to the building structure by being secured to a steel stand-off bracket 3410. This stand-off bracket is attached to a U-shaped steel piece 3412 that is part of the support structure of the building, together with a drywall piece 3416.

Figure 36:
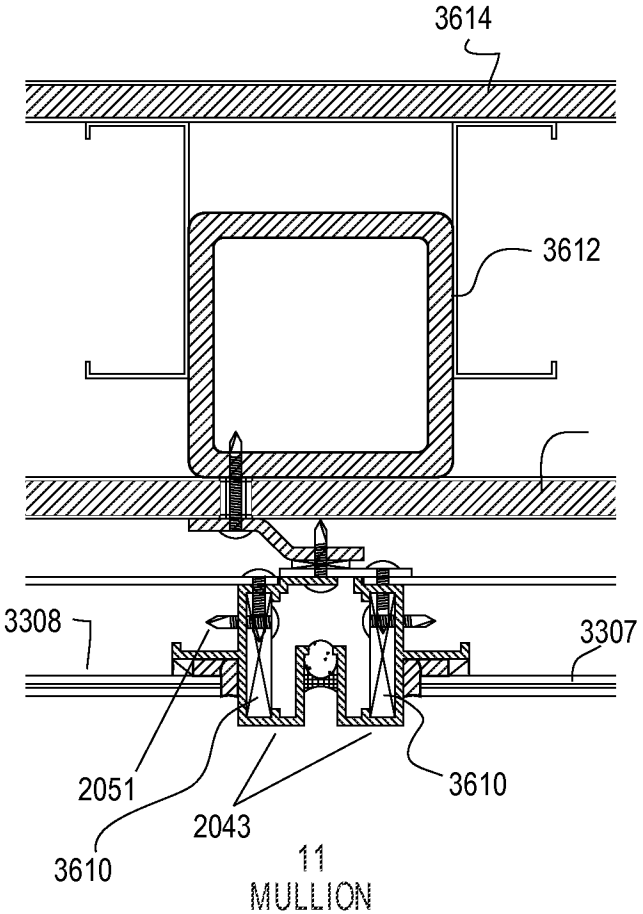
FIG. 36 shows a sectional view of a mullion section of the shadow box.

The other side of the glazing unit 3308 is held by a mullion section, illustrated in FIG. 36. This is an example of a back-to-back mullion where shear block 3610 has been inserted into a pocket formed directly behind the L-shaped section of each shadow box frame 2043. This shear block 3610 is actually angled so as to fit into the pockets of adjoining jamb and head/sill sections. The far end of the shadow box frame 2043 is attached to another stand-off bracket 3610 that is, in this case, fastened to a steel tube 3612 that runs vertically as part of the building support structure. In this embodiment, there is a drywall piece 3614 both on the front side and to the back of this support structure tube.

Figure 37:
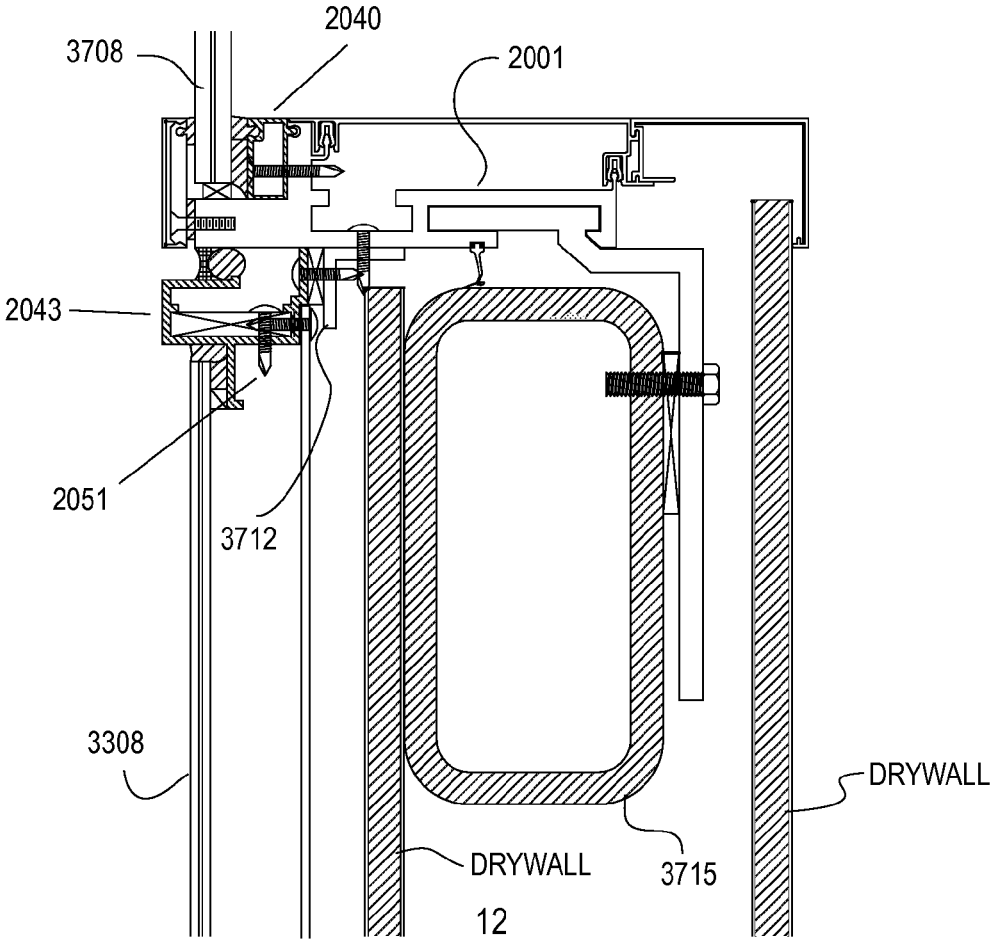
FIG. 37 is a view of the head section of the shadow box.
Figure 38:
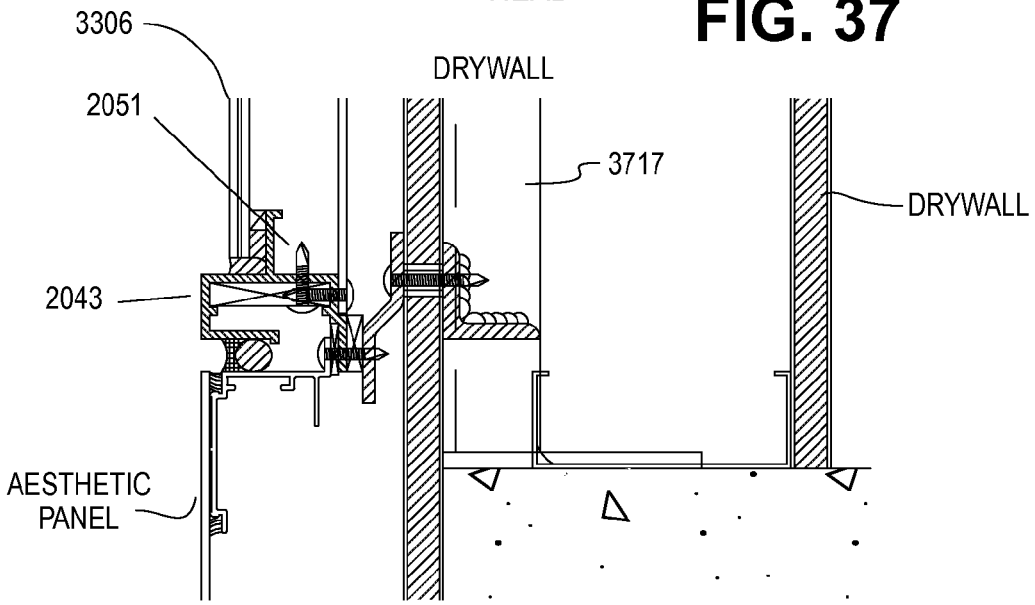
FIG. 38 is a view of the sill section of the shadow box.

The head and sill sections of the fake window of FIG. 33 are depicted in FIGS. 37 and 38. Another instance of the shadow box frame 2043 is used for each of the head and sill sections. The glazing unit 3308 is glued into the corner of the respective shadow box frames. For the head section, the shadow box frame is attached in the same manner as in the jamb, except rather than being fastened to a stand-off bracket, it is fastened to an L-shaped bracket 3712 whose other segment is secured to the base 2001 of the sill section of an adjacent actual window. The building support structure in this case consists of a steel tube 3715 that runs horizontally in the building, and is used to anchor the framing system. There is also a steel tube 3717 that runs vertically, for example, every two feet, between the floor and ceiling. These metal support structures are used to anchor the actual window and the shadow box frames described here. Also note that in this embodiment, shown in FIG. 37, the glazing unit 3708 is relatively thin, such that an in-fill adapter bar 2040 fills the void that has been created by use of thinner glass, without having to modify the height of the L-shaped cross-section of the base piece 2001.

Figure 39:
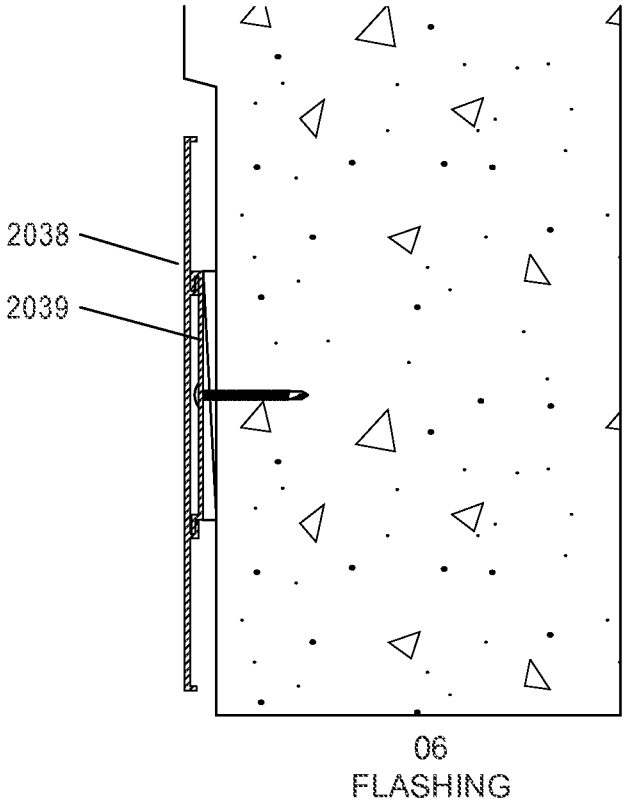
FIG. 39 is a sectional view of a panel flashing.
Figure 40:
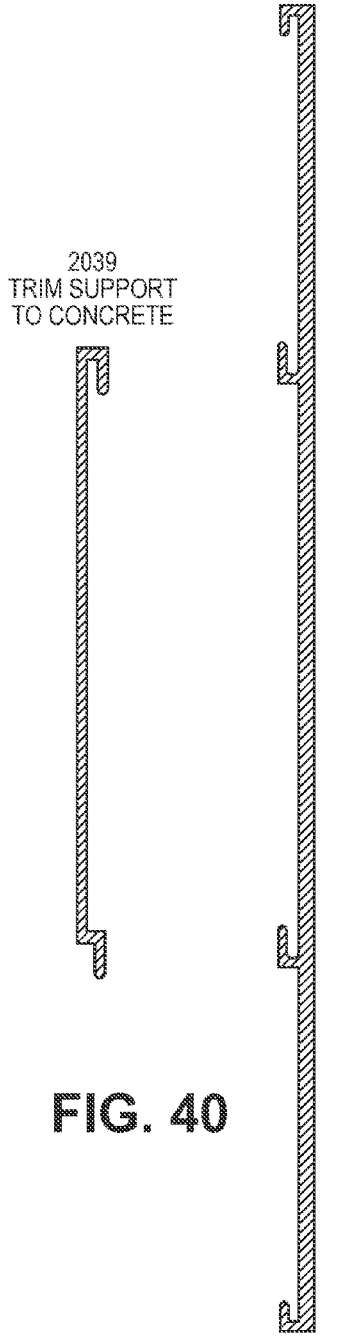
FIG. 40 shows trim pieces for the panel flashing.

Finally, turning now to FIG. 39, a sectional view of a panel flashing mounted to a concrete block facing the threat side is shown. In this case, an aesthetic affect may be obtained by providing a continuous panel 106 below the concrete block 102 shown in FIG. 1. This panel is composed of two pieces, namely a support piece 2039 that is fastened directly to the concrete as shown, and a trim piece 2038 that slides onto the support piece, as shown. The two pieces are locked together in a transverse direction by virtue of mating hook pairs at the bottom and at the top, as shown (see also FIG. 40).

Installation Techniques

There are several different manufacturing and assembly processes that may be followed to install the different embodiments of the primary frame described above, as part of a security window installation. For example, in the so-called kit technique, the individual pressure plate and base pieces are measured and pre-cut from their respective extruded aluminum beams at the factory (and all or most of the holes are predrilled) according to a standard or specially ordered specification. They are then shipped as a combination of mostly loose pieces with perhaps some partially assembled framing sections to the job site, i.e. mostly unassembled. This allows some final trimming and adjustments, if needed, to be easily made to each piece at the job site. Next, the perimeter pieces (including the sill/head base and base extensions, excluding the glazing units and pressure plates) are anchored to the building material at the job site, using for example the fastener mechanisms described above. The resulting assembly may also include a mullion that is attached to a perimeter piece. Next, a glazing unit is placed in the corners of the assembly. This may be preceded by installing an EPDM seal or gasket and applying liquid caulking to the corners of the base pieces as illustrated above. Finally, the pressure plates are placed up against the glazing unit and against the L-shaped sections of the base pieces, and may then be secured in place using a fastener mechanism. Aesthetic cover caps may then be positioned in place, to complete the installation of the security window.

Another manufacturing and assembly process is referred to as the "knock down" technique. In that case, substantially all of the perimeter pieces (as well as mullions, if any) are attached to each other at the factory into a sub-frame assembly unit. This unit is then shipped to the job site. Next, the sub-frame assembly unit is anchored into its opening at the job site (using a fastener mechanism). The rest of the operations described above for the kit technique may then be followed, starting with placement of the glazing unit in the corners of the sub-frame assembly, to complete the security window installation.

In still another technique, one or more glazing units are placed in the corners of the sub-frame assembly unit and secured in place (by attaching the pressure plates) at the factory. In this unitized approach, the completed window or combo unit is then shipped to the job site, where it is then fitted (plumbed and squared) into its opening. Fasteners are then applied (through the predrilled holes in the angled anchor bases, for example) to anchor the combo unit to the building material. This embodiment may be particularly desirable for buildings that call for a large number of security windows, due to its relatively short installation time. For example, such a technique may be desirable in the construction of high-rise buildings where a crane may be available to lift the relatively bulky and heavy combo units to the upper floors for installation.

The invention is not limited to the specific embodiments described above. For example, if a shear block can be held fixed (longitudinally) in its pocket, between two angle blocks at the ends of a base piece that join with jamb sections, then there may be no need for a separate fastener mechanism to secure the shear block. Accordingly, other embodiments are within the scope of the claims.

What is claimed is:

1. A window framing system, comprising:

a plurality of pieces that are components of a frame for a window having a threat side and a safe side, wherein the pieces include a base and a pressure plate that together form part of one of a sill section, a head section, and a jamb section of the window;

the base and pressure plate being elongated in a longitudinal direction;

the base having (1) an L-shaped cross-section at a near portion of the base to receive an end of a glazing unit from the threat side of the window, (2) a first pocket formed in a far portion of the base and running in the longitudinal direction, the first pocket having a first opening formed through a side of the base which is opposite a side dimensioned to receive the end of the glazing unit and that is dimensioned to receive an L-shaped base angle piece such that a first perpendicular segment of the base angle piece is positioned within the first pocket and a second perpendicular segment extends outside of the first pocket, and wherein the near portion being closer to the threat side than the far portion, and (3) a second pocket formed in a middle portion of the base, between the L-shaped section and the first pocket, the second pocket running in the longitudinal direction and having a second opening formed through the side of the base dimensioned to receive the end of the glazing unit, and running the entire length of the second pocket; and the pressure plate to be assembled with the base so as to secure the glazing unit in the corner.

2. The system of claim 1 wherein the base has an opening to the first pocket that runs the entire length of the first pocket in the longitudinal direction.

3. The system of claim 2 further comprising a cover sized to fit over the base and having a clip, wherein the base further comprises a finger formed integrally with the base as part of the same extruded piece of metal, to receive the clip.

4. The system of claim 3 wherein the clip is a PVC clip to thermally insulate the cover and the base.

5. The system of claim 1 further comprising the base angle piece that is L-shaped with first and second perpendicular segments, the first segment being shaped to mate with and slide into the first pocket, the second segment having a plurality of holes spaced in said longitudinal direction, the system further comprising a plurality of fasteners to anchor the frame through the plurality of holes to a building support structure.

6. The system of claim 1 further comprising a plurality of fasteners, wherein the base and pressure plate are elongated in a longitudinal direction, and a plurality of holes spaced in the longitudinal direction are formed facing the threat side in the near portion of the base, the plurality holes to receive the plurality of fasteners for securing the glazing unit.

7. The system of claim 1 wherein the plurality of pieces include a jamb base and a jamb pressure plate having substantially the same cross-sections, respectively, as said base and said pressure plate.

8. The system of claim 7 wherein said base and said pressure plate together form part of one of the sill section and the head section of the window, the system further comprising an L-shaped shear block to join a jamb of the window with one of the sill and head, the L-shaped shear block having a first segment shaped to fit into the first pocket of the sill or head base, and a second segment shaped to fit into the first pocket of the jamb base.

9. The system of claim 7 wherein the plurality of pieces include a mullion base and a mullion pressure plate, the mullion base and the mullion pressure plate having substantially the same cross-sections, respectively, as said base and said pressure plate.

10. The system of claim 9 further comprising the glazing unit, wherein the pieces have been assembled into a complete window including the glazing unit secured in said corners and packaged to be shipped to a job site.

11. The system of claim 10 wherein each of the pieces is essentially made of a continuous piece of extruded aluminum, and the pieces have been secured to each other without welding together any of the pieces.

12. The system of claim 6 wherein the pressure plate has a pair of indentations on opposite ends running longitudinally, to receive via snap fit a cover cap that hides the plurality of fasteners.

13. A method for assembling a window, comprising:

inserting a base anchor angle into a first pocket of a base for a sill section of the window, wherein the base anchor angle has an elongated shear block with an L-shaped cross-section whose first segment is inserted lengthwise into the first pocket;

joining a base for a jamb section of the window with the base of the sill section;

setting first and second ends of a glazing unit from a threat side of the window into respective corners of L-shaped sections of the sill and jamb bases;

setting first and second pressure plates against the glazing unit, with a plurality of holes in each pressure plate being aligned with a plurality of holes in a respective L-shaped section of the sill and jamb bases;

applying a plurality of fasteners to the plurality of holes in the pressure plates to secure the glazing unit in said corners; and anchoring the window to a side of a support structure of a building, by applying a plurality of fasteners to a plurality of holes in a second segment of the elongated shear block having an L-shaped cross section, wherein the second segment extends outside of the first pocket in a direction parallel to the side of the support structure and the threat side of the window.

14. The method of claim 13 further comprising:

installing a weather seal into a groove formed in the L-shaped section of the sill base, prior to setting the glazing unit into the corner in contact with the installed seal.

15. The method of claim 13 wherein the jamb base and sill base are joined using an angled shear block having first and segments, the first segment being inserted into the first pocket of the sill base and the second segment being inserted into the first pocket of the jamb base.

16. The method of claim 13 further comprising:

sliding the base anchor angle in the first pocket, along a length of the base, to a position at which the fasteners are applied to anchor the window.

* * * * *

UNITED STATES PATENT AND TRADEMARK OFFICE

CERTIFICATE OF CORRECTION

PATENT NO. : 8,407,953 B2
APPLICATION NO. : 13/371982
DATED : April 2, 2013
INVENTOR(S) : Murray L. Neal It is certified that error appears in the above-identified patent and that said Letters Patent is hereby corrected as shown below:

In the Claims, Column 16, Claim 15, lines 26-27, please delete "first and segments" and insert --first and second segments--.

Signed and Sealed this
Twenty-eighth Day of May, 2013

Teresa Stanek Rea
*Acting Director of the United States Patent and Trademark Office*